US005437967A

United States Patent [19]

Naruse et al.

[11] Patent Number: 5,437,967

[45] Date of Patent: Aug. 1, 1995

[54] SILVER HALIDE COLOR PHOTOGRAPHIC LIGHT-SENSITIVE MATERIAL

[75] Inventors: Hideaki Naruse; Makoto Suzuki, both of Kanagawa, Japan

[73] Assignee: Fuji Photo Film Co., Ltd., Kanagawa, Japan

[21] Appl. No.: 228,908

[22] Filed: Apr. 18, 1994

Related U.S. Application Data

[62] Division of Ser. No. 982,773, Nov. 27, 1992, Pat. No. 5,340,706.

[30] Foreign Application Priority Data

Nov. 27, 1991 [JP] Japan ..... 3-335905

[51] Int. Cl.[6] ..... G03C 1/46

[52] U.S. Cl. ..... 430/505; 430/558; 430/384; 430/385

[58] Field of Search ..... 430/384, 385, 558, 505

[56] References Cited

U.S. PATENT DOCUMENTS

| | | | |
|---|---|---|---|
| 4,873,183 | 10/1989 | Tachibana et al. | 430/550 |
| 4,910,127 | 3/1990 | Sakaki et al. . | |
| 5,091,297 | 2/1992 | Fukunaga et al. | 430/558 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0488248 | 6/1992 | European Pat. Off. . |
| 0491197 | 6/1992 | European Pat. Off. . |
| 3141057 | 12/1986 | Japan . |
| 3149647 | 12/1986 | Japan . |
| 3264755 | 4/1987 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material capable of providing a dye image having excellent color reproducibility, less fading of cyan, magenta and yellow colors and a dye image fastness with a good balance of the three colors, comprise a support and provided thereon a silver halide light-sensitive layer containing a cyan coupler, a silver halide light-sensitive layer containing a magenta coupler, and a silver halide light-sensitive layer containing a yellow coupler, wherein the silver halide light-sensitive layer containing the cyan coupler contains at least one pyrrolotriazole cyan couplers represented by the following Formula (I) or (II) as a cyan coupler and the silver halide light-sensitive layer containing the magenta coupler contains a pyrazoloazole magenta coupler represented by the following Formula (M) as a magenta coupler:

(I)

Formula (II)

(M)

wherein the substituents are defined herein the specification.

13 Claims, No Drawings

SILVER HALIDE COLOR PHOTOGRAPHIC LIGHT-SENSITIVE MATERIAL

This is a divisional of application Ser. No. 07/982,773, filed Nov. 27, 1992, now U.S. Pat. No. 5,340,706.

FIELD OF THE INVENTION

The present invention relates to a silver halide color photographic light-sensitive material capable of providing a dye image having excellent color reproducibility, less fading of three colors including cyan, magenta and yellow colors and in addition, a dye image fastness with a good balance of the three colors.

BACKGROUND OF THE INVENTION

In a silver halide color photographic light-sensitive material, the phenol type and naphthol type couplers are well known as generally used cyan couplers. Meanwhile, in recent years, research efforts have been directed to developing cyan couplers which provide high color developability and dye image fastness and excellent color reproducibility by improving the color developability (which relates to coupling activity and the molecular extinction coefficient of the dye obtained), the fastness of the dye obtained, and the absorption characteristic un to the dye obtained from the phenol type and naphthol type couplers. Couplers developed through such efforts include, for example, the 3-hydroxypyridine type compounds described in European Patent Publication 333,185, the 3H-2-dicyanomethylidene-thiazoles described in European Patent Publication 362,808, the 3-dicyanomethyl-idene-2,3-dihydrobenzothiophene-1,1-dioxides described in JP-A-64-32260 (the term "JP-A" as used herewith means an unexamined Japanese patent application), the pyrazoloazoles described in JP-A-63-264753 and U.S. Pat. No. 4,873,183, the imidazoles described in U.S. Pat. Nos. 4,818,672 and 4,921,783 and JP-A-3-48243, the pyrazolopyrimidones and pyrazoloquinazolones described in European Patent Publications 304,001, 329,036 and 374,781, and JP-A-2-85851, and the condensed triazoles described in European patent Publication 342,637.

However, these proposed novel cyan couplers do not simultaneously satisfy all of the above requirements for excellent color developability, dye image fastness and color reproducibility, and they can not be put to practical use without further research and development.

Couplers which have the same basic structure as that of the pyrrolotriazole type cyan coupler according to the present invention are shown in Formulas (IX), (XIII), (XV) and (XX) of Formulas (II) to (XXXV) of JP-A-62-278552, and two specific compounds are exemplified for each of these formulas. Compounds having the same bisic structure are also proposed in Formulas (I) and (II) of JP-A-62-279340, and forty two specific compounds are exemplified.

However, all of the compounds described in JP-A-62-278552 and JP-A-62-279340 are magenta couplers. Accordingly, even if they have the same basic structure, they are completely different from the cyan couplers of the present invention, which provide a cyan dye by reaction with an oxidation product of a color developing agent as a result of a particular substituent present in the cyan couplers of the present invention.

Further, compounds represented by Formulas (IV) to (XVII) are specifically proposed in JP-A-1-288855 as cyan couplers having a novel basic structure, and among them, the compounds represented by Formulas (IV) and (V) are described as a pyrrolotriazole type cyan coupler. In particular, the compounds represented by Formula (IV) are pyrrolotriazole type couplers with the same basic structure as that of the cyan coupler of the present invention, but the active site thereof at which they are subjected to a coupling reaction with an oxidation product of a color developing agent is different from that of the coupler of the present invention according to the structure shown in the above patent. In addition, the coupling activity of the couplers exemplified in the above patent is low and it is difficult to put them to practical use.

Meanwhile, well known as a magenta coupler is a 5-pyrazolone type magenta coupler having an acylamino group or anilino group at a 3-position and a phenyl group at a 1-position. In recent years, pyrazoloazole type magenta couplers have been rapidly developed and some of them have begun to be put to practical use since they have different characteristics from those of the conventional 5-pyrazolone type magenta couplers, for example, excellent color reproducibility without having a secondary absorption at a shorter wavelength side (about 430 nm) of a primary absorption wavelength in an absorption characteristic of the dye obtained therefrom and excellent dye image fastness.

However, this pyrazoloazole type magenta coupler as well as the above cyan couplers can not simultaneously satisfy such performance characteristics as color developability, dye image fastness and color reproducibility, and further research and development is necessary.

As stated above, the improvement of the characteristics of the cyan and magenta couplers such as a color developability, dye image fastness and color reproducibility and the introduction thereof into a light-sensitive material does not necessarily result in a light-sensitive material which demonstrates all of these excellent performance characteristics simultaneously and in some cases, the performance characteristics are rather unfavorable. Unless the fastnesses of the three colors of cyan, magenta and yellow reside at the same level, even if these fastnesses including that with a yellow coupler are improved, the color balance of a dye image formed will collapse and will result in a deteriorated image quality.

SUMMARY OF THE INVENTION

Accordingly, an object of the present invention is to provide a color photographic light-sensitive material providing a dye image fastness with a good balance between the three colors of cyan, magenta and yellow as well as excellent dye image fastness and color reproducibility.

To achieve the above and other objects, the present invention provides a silver halide color photographic light-sensitive material comprising a support and provided thereon a silver halide light-sensitive layer containing a cyan coupler, a silver halide light-sensitive layer containing a magenta coupler, and a silver halide light-sensitive layer containing a yellow coupler, wherein the silver halide light-sensitive layer containing the cyan coupler contains at least one pyrrolotriazole cyan coupler represented by the following Formula (I) or (II) as a cyan coupler, and the silver halide light-sensitive layer containing the magenta coupler contains a pyrazoloazole magenta coupler represented by the following Formula (M) as a magenta coupler:

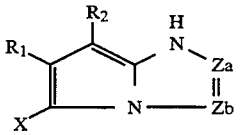

Formula (I)

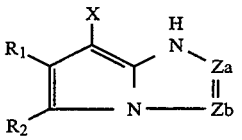

Formula (II)

wherein Za and Zb each represents —C($R_3$)= or —N=, provided that one of Za and Zb is —N= and the other is —C($R_3$)=; $R_1$ and $R_2$ each represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; the group represented by $R_1$, $R_2$, $R_3$ or X may a divalent group and combine with a polymer which is higher than a dimer and which has a high molecular weight chain to form a homopolymer or a copolymer;

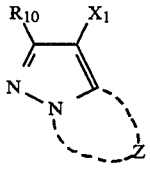

Formula (M)

wherein $R_{10}$ represents a hydrogen atom or a substituent; Z represents a group of non-metallic atoms necessary to form a 5-membered azole ring containing 2 to 3 nitrogen atoms, wherein the azole ring may have a substituent (including a condensed ring); and $X_1$ represents a hydrogen atom or a group capable of splitting off upon a coupling reaction with an oxidation product of an aromatic primary amine color developing agent.

Thus, in the present invention, at least one of the pyrrolotriazole couplers of the present invention represented by Formula (I) or (II) is incorporated into a silver halide emulsion layer containing a cyan coupler in a silver halide color photographic light-sensitive material and at least one pyrazoloazole magenta coupler of the present invention represented by formula (M) is incorporated into a silver halide emulsion layer containing a magenta coupler to provide a silver halide color photographic light-sensitive material having improved color developability and excellent dye image fastness and color reproducibility.

DETAILED DESCRIPTION OF THE INVENTION

The present invention will be explained below in detail.

First, Formulas (I) and (II) will be explained. Za and Zb each represents —C($R_3$)= or —N=, provided that one of Za and Zb is —N= and the other is —C($R_3$).

That is, to be specific, the cyan couplers of the present invention are cyan dye-forming couplers which are represented by the following Formulas (I-a), (I-b), (II-a) and (II-b):

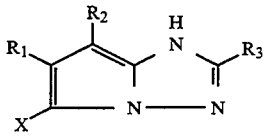

(I-a)

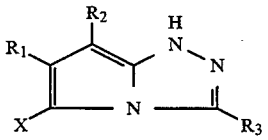

(I-b)

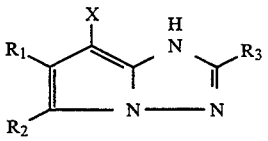

(II-a)

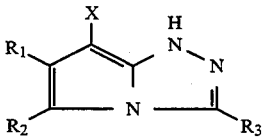

(II-b)

wherein $R_1$, $R_2$, $R_3$ and X have the same meaning as $R_1$, $R_2$, $R_3$ and X in Formulas (I) and (II), respectively.

$R_3$ represents a hydrogen atom or a substitutent, and there can be given as examples of the substituent, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. Of these substituents, the substituents other than the halogen atom, the cyano group, the hydroxy group, the nitro group, the carboxy group and the sulfo group may further be substituted with the substituents exemplified for $R_3$.

To be more specific, $R_3$ may represent a hydrogen atom, a halogen atom (for example, a chlorine atom and a bromine atom), an aliphatic group (which has preferably 1 to 32 carbon atoms and may be linear or branched and saturated or unsaturated, for example, an alkyl group, an aralkyl group, an alkenyl group, a cycloalkyl group, and a cycloalkenyl group, with the alkyl group being preferred; to be in more detail, for example, methyl, ethyl, propyl, isopropyl, t-butyl, tridecyl, 2-methanesulfonylethyl, 3-(3-pentadecylphenoxy)propyl, 3-[4-}2-[4-(4-hydroxyphenylsulfonyl)-phenoxy]-dodecanamide}-phenyl]propyl, 2-ethoxytridecyl, trifluoromethyl, cyclopentyl, and 3-(2,4-di-t-amylphenoxy)-propyl), an aryl group (having preferably 6 to 50 carbon atoms, for example, phenyl, 4-t-butylphenyl, 2,4-di-t-amylphenyl, and 4-tetradecanamidephenyl), a heterocyclic group (having preferably 1 to 50 carbon atoms, for example 2-furyl, 2-thienyl, 2-pyrimidinyl, and 2-benzothiazolyl), a cyano group, a hydroxy group, a nitro group, a carboxy group, a sulfo group, an amino group, an alkoxy group (having preferably 1 to 50 carbon atoms, for example, methoxy, ethoxy, 2-methoxyethoxy, 2-dodecylethoxy, and 2-methanesulfonylethoxy), an aryloxy group (having preferably 6 to 50 carbon atoms, for example, phenoxy, 2-methylphenoxy, 4-t-butylphenoxy, 3-nitrophenoxy, 3-t-butyloxycarbammoyl-phenoxy, and 3-methoxycarbamoyl), an acylamino group (having preferably 2 to 50 carbon atoms, for example, acetamido, benzamido, tetradecanamido, 2-(2,4-di-t-amylphenoxy)butanamido, 4-(3-t-butyl-4-hydroxyphenoxy)-butanamido, and 2-[4-(4-hydroxyphenylsulfonyl)phenoxy]-decanamido), an alkylamino group (having preferably 1 to 50 carbon atoms, for example, methylamino, butylamino, dodecylamino, diethylamino, and methylbutylamino), an anilino group (having preferably 6 to 50 carbon atoms, for example, phenylamino, 2-chloroanilino, 2-chloro-5-tetradecanaminoanilino, 2-chloro-5-dodecyloxycarbonylanilino, N-acetylanilino, and 2-chloro-5-[2-(3-t-butyl-4-hydroxyphenoxy)dodecanamide]anilino), a ureido group (having preferably 2 to 50 carbon atoms, for example, phenylureido, methylureido, and N,N-dibutylureido), a sulfamoylamino group (having preferably 1 to 50 carbon atoms, for example, N,N-dipropylsulfamoylamino, and N-methyl-N-decylsulfamoylamino), an alkylthio group (having preferably 1 to 50 carbon atoms, for example, methylthio, octylthio, tetradecylthio, 2-phenoxyethylthio, 3-phenoxypropylthio, and 3-(4-t-butylphenoxy)propylthio), an arylthio group (having preferably 6 to 50 carbon atoms, for example, phenylthio, 2-butoxy-5-t-octylphenylthio, 3-pentadecylphenylthio, 2-carboxyphenylthio and 4-tetradecanamidephenylthio), an alkoxycarbonylamino group (having preferably 2 to 50 carbon atoms, for example, methoxycarbonyl-amino and tetradecyloxycarbonylamino), a sulfonamido group (having preferably 1 to 50 carbon atoms, for example, methanesulfonamido, hexadecanesulfonamido, benzenesulfonamido, p-toluenesulfonamido, octadecanesulfonamido, and 2-methoxy-5-t-butylbenzenesulfonamido), a carbamoyl group (having preferably 1 to 50 carbon atoms, for example, N-ethylcarbamoyl, N,N-dibutylcarbamoyl, N-(2-dodecyloxyethyl)carbamoyl, N-methyl-N-dodecylcarbamoyl, and N-[3-(2,4-di-t-amylphenoxy)-propyl]carbamoyl), a sulfamoyl group (having preferably 0 to 50 carbon atoms, for example, N-ethylsulfamoyl, N,N-dipropyl-sulfamoyl, N-(2-dodecyloxyethyl)-sulfamoyl, N-ethyl-N-dodecylsulfamoyl, and N,N-diethylsulfamoyl), a sulfonyl group (having preferably 1 to 50 carbon atoms, for example, methanesulfonyl, octanesulfonyl, benzenesulfonyl, and toluenesulfonyl), an alkoxycarbonyl group (having preferably 2 to 50 carbon atoms, for example, methoxycarbonyl, butyloxycarbonyl, dodecyloxycarbonyl, and octadecyloxycarbonyl), a heterocyclic oxy group (having preferably 1 to 50 carbon atoms, for example, 1-phenyltetrazole-5-oxy, and 2-tetrahydropyranyloxy), an azo group (having preferably 6 to 50 carbon atoms, for example, phenylazo, 4-methoxyphenylazo, 4-pivaloylaminophenylazo, and 2-hydroxy-4-propanoylphenylazo), an acyloxy group (having preferably 2 to 50 carbon atoms, for example, acetoxy), a carbamoyloxy group (having preferably 2 to 50 carbon atoms, for example, N-methylcarbamoyloxy and N-phenylcarbamoyloxy), a silyloxy group (having preferably 3 to 50 carbon atoms, for example, trimethylsilyloxy and dibutylmethylsilyloxy), an aryloxycarbonylamino group (having preferably 7 to 50 carbon atoms, for example, phenoxycarbonylamino), an imido group (having preferably 1 to 40 carbon atoms, for example, N-succinimido, N-phthalimido, and 3-octadecenylsuccinimido), a heterocyclic thio group (having preferably 1 to 50 carbon atoms, for example, 2-benzothiazolylthio, 2,4-di-phenoxy-1,3,5-triazole-6-thio, and 2-pyridylthio), a sulfinyl group (having preferably 1 to 50 carbon atoms, for example, dodecanesulfinyl, 3-pentadecylphenyl-sulfinyl, and 3-phenoxypropylsulfinyl), a phosphonyl group (having preferably 1 to 50 carbon atoms, for example, phenoxyphosphonyl, octyloxyphosphonyl, and phenylphosphonyl), an aryloxycarbonyl group (having preferably 7 to 50 carbon atoms, for example, phenoxycarbonyl), an acyl group (having preferably 2 to 50 carbon atoms, for example, acetyl, 3-phenylpropanoyl, benzoyl, and 4-dodecyloxybenzoyl), and an azolyl group (having preferably 1 to 50 carbon atoms, for example, imidazolyl, pyrazolyl, 3-chloropyrazole-1-yl, and triazolyl).

There can be preferably given as $R_3$, an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

$R_3$ is further preferably an alkyl group or an aryl group. It is more preferably an alkyl group aryl group having at least one substituent which provides a flocculation property, and further preferably an alkyl group or aryl group each having at least one alkoxy group, sulfonyl group, sulfamoyl group, carbamoyl group, acylamido group, or sulfonamido group as a substituent. It is particularly preferably an alkyl group or aryl group each having at least one acylamido group or sulfonamido group as a substituent. These substituents when substituted on an aryl group are more preferably substituted at least at an ortho position.

In the cyan coupler of the present invention, $R_1$ and $R_2$ each are an electron attractive group having a $\sigma_p$ value of 0.2 or more, and a value of 0.65 or more in the total of the $\sigma_p$ values of $R_1$ and $R_2$ makes it possible to develop a color to form a cyan dye image. The total of the $\sigma_p$ values of $R_1$ and $R_2$ is preferably 0.70 or more and the upper limit thereof is not much more than 1.8.

$R_1$ and $R_2$ each are an electron attractive group having a Hammett's substituent constant $\sigma_p$ of 0.20 or more, preferably 0.30 or more. The upper limit thereof is 1.0 or less. The Hammett's rule is an emperical rule which was proposed by L. P. Hammett in 1935 in order to quantitatively asses the affects exerted by a substituent on a reaction or equilibrium of a benzene derivative. In these days, the propriety thereof is widely accepted.

The $\sigma_p$ value and $\sigma_m$ value are available as the substituent constant obtained according to the Hammett's rule and the values thereof are described in many publications. They are described in, for example, *Lange's Handbook of Chemistry*, Vol. 12, edited by J. A. Dean, 1979 (McGrow-Hill) and *Chemical Region* No. 122, pp. 96 to 103, 1979 (Nankohdo). In the present invention, $R_1$ and $R_2$ are determined by reference to the Hammett's substituent constant $\sigma_p$ value, but this does not mean that they are limited to the substituents the $\sigma_p$ values of which are described in these publications. Even if the $\sigma_p$ value of a particular group is not be described in the publications, the particular group is naturally included in the scope of the present invention as long as it satisfies the above Hammett's substituent range when it is measured according to Hammett's rule.

There can be given as specific examples of groups represented by $R_1$ and $R_2$ which are the electron attractive groups having $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with anr electron attractive group having a $\sigma_p$ of 0.20 or more, a heterocyclic group, a halogen atom, an azo group, and a selenocyanato group. Of these substituents, groups capable of further having substituents may further have the substituents given for the groups defined for $R_3$.

To explain $R_1$ and $R_2$ in more detail, there can be given as specific examples of the electron attractive groups having $\sigma_p$ values of 0.20 or more, an acyl group (having preferably 1 to 50 carbon atoms, for example, acetyl, 3-phenylpropanoyl, benzoyl, and 4-dodecyloxybenzoyl), an acyloxy group (for example acetoxy), a carbamoyl group (having preferably 0 to 50 carbon atoms, for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, and N-[3-(2,4-di-t-amylphenoxy)propyl]carbamoyl), an alkoxycarbonyl group (having preferably 2 to 50 carbon atoms, for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, and octadodecyloxycarbonyl), an aryloxycarbonyl group (having preferably 7 to 50 carbon atoms, for example, phenoxycarbonyl), a cyano group, a nitro group, a dialkylphosphono group (having preferably 2 to 50 carbon atoms, for example, dimethylphosphono), a diarylphosphono group (having preferably 12 to 60 carbon atoms, for example, diphenylphosphono), a diarylphosphinyl group (having preferably 12 to 60 carbon atoms, for example, diphenylphosphinyl), an alkylsulfinyl group (having preferably 1 to 50 carbon atoms, for example, 3-phenoxypropylsulfinyl), an arylsulfinyl group (having preferably 6 to 50 carbon atoms, for example, 3-pentadecylphenylsulfinyl), an alkylsulfonyl group (having preferably 1 to 50 carbon atoms, for example, methanesulfonyl and octanesulfonyl), an arylsulfonyl group (having preferably 6 to 50 carbon atoms, for example, benzenesulfonyl and toluenesulfonyl), a sulfonyloxy group (having preferably 1 to 50 carbon atoms, for example, methanesulfonyloxy and toluenesulfonyloxy), an acylthio group (having preferably 1 to 50 carbon atoms, for example, acetylthio and benzoylthio), a sulfamoyl group (having preferably 0 to 50 carbon atoms, for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a thiocyanate group, a thiocarbonyl group (having preferably 2 to 50 carbon atoms, for example, methylthiocarbonyl and phenylthiocarbonyl), a halogenated alkyl group (having preferably 1 to 20 carbon atoms, for example, trifluoromethane and heptafluoropropane), a halogenated alkoxy group (having preferably 1 to 20 carbon atoms, for example, trifluoromethyloxy), a halogenated aryloxy group (having preferably 6 to 12 carbon atoms, for example, pentafluorophenyloxy), a halogenated alkylamino group (having preferably 1 to 20 carbon atoms, for example, N,N-di-(trifluoromethyl-)amino), a halogenated alkylthio group (having preferably 1 to 20 carbon atoms, for example, difluoromethyl and 1,1,2,2-tetrafluoroethylthio), an aryl group substituted with an electron attractive group having a $\sigma_p$ of 0.20 or more (having preferably 6 to 20 carbon atoms, for example, 2,4-dinitrophenyl, 2,4,6-trichlorophenyl, and pentachlorophenyl), a heterocyclic group (having preferably 0 to 40 carbon atoms, for example, 2-benzoxazolyl, 2-benzothiazolyl, 1-phenyl-2-benzimidazolyl, 5-chloro-1-tetrazolyl, and 1-pyrrolyl), a halogen atom (for example, a chlorine atom and a bromine atom), an azo group (having preferably 6 to 40 carbon atoms, for example, phenylazo), and a selenocyanato group. Of these substituents, groups capable of further having substituents may have the substituents given for the groups defined for $R_3$.

There can be given as the preferable substituents represented by $R_1$ and $R_2$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with an electron attractive group having a $\sigma_p$ of 0.20 or more, and a heterocyclic group. More preferred are an alkoxycarbonyl group, a nitro group, a cyano group, an arylsulfonyl group, a carbamoyl group and a halogenated alkyl group.

Most preferred as $R_1$ is a cyano group. Particularly preferred as $R_2$ is an alkoxycarbonyl group and most preferred is a branched alkoxycarbonyl group.

X represents a hydrogen atom or a group capable of splitting off by a coupling reaction with an oxidation product of an aromatic primary amine color developing agent. To explain the group capable of splitting off in detail, there can be given as examples, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, and an arylazo group. These groups may further be substituted with the groups allowable as the substituent for $R_3$.

To be more specific, there can be given as suitable examples of X, a halogen atom (for example, a fluorine atom, a chlorine atom and a bromine atom), an alkoxy group (having preferably 1 to 50 carbon atoms, for example, ethoxy, dodecyloxy, methoxyethylcarbamoylmethoxy, carboxypropyloxy, methylsulfonylethoxy, and ethoxycarbonylmethoxy), an aryloxy group (having preferably 6 to 50 carbon atoms, for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzolyoxy), an alkyl- or arylsulfonyloxy group (having preferably 1 to 50 carbon atoms, for example, methanesulfonyloxy and toluenesulfonyloxy), an acylamino group (having preferably 2 to 50 carbon atoms, for example, dicholoroacetylamino and heptafluorobutylylamino), an alkyl or arylsulfonamido group (having preferably 1 to 50 carbon atoms, for example, methanesulfonamido, trifluoromethanesulfonamido, and p-toluenesulfonylamino), an alkoxycarbonyloxy group (having preferably 2 to 50 carbon atoms, for example, ethoxycarbonyloxy and benzyloxycarbonyloxy), an aryloxycarbonyloxy group (having preferably 7 to 50 carbon atoms, for example, phenoxycarbonyloxy), an alkyl-, aryl- or heterocyclic thio group (having preferably 1 to 50 carbon atoms, for example, dodecylthio, 1-carboxydodecylthio, phenylthio, 2-butoxy-5-t-octylphenylthio, and tetrazolylthio), a carbamoylamino group (having preferably 2 to 50 carbon atoms, for example, N-methylcarbamoyl-amino and N-phenylcarbamoylamino), a 5-membered or 6-membered nitrogen-containing heterocyclic group (having preferably 1 to 50 carbon atoms, for example, imidazolyl, pyrazolyl, triazolyl, tetrazolyl, and, 2-dihydro-2-oxo-1-pyridyl), an imido group (having preferably 1 to 50 carbon atoms, for example, succinimido and hydantoinyl), and an arylazo group (having preferably 6 to 40 carbon atoms, for example, phenylazo and 4-methoxyphenylazo). In addition to the above groups, X may take, as a splitting group bonded through a carbon atom, a bis type coupler form obtained by condensing a 4-equivalent coupler with aldehydes or ketones as described in *The Theory of the Photographic Process*, by T. H. James, 4th Ed., (Macmillan Publishing Co., Inc.), Ch. 12, Sec. III.C. pp. 356–358 and in the *Paper from ICPS* '82 (International Congress of Photographic Science, University of Cambridge, Sep. 6–10, 1982, The Royal Phot. Sci. of Great Britain), No. 4.20 "Formation and Coupling Behaviour of 4,4'-Methylidene bis- and 4-Methylidene Pyrazoline-5-ones". Further, X may contain photographically useful groups such as a development inhibitor and a development accelerator described in *Research Disclosure*, No. 307105, VII, Item F.

X is preferably a halogen atom, an alkoxy group, an aryloxy group, an alkyl or arylthio group, or a 5-membered or 6-membered nitrogen-containing heterocyclic group bonded to a coupling active site via the nitrogen atom. X is more preferably a halogen atom, or an alkyl- or arylthio group. Particularly preferred is an arylthio group.

In the cyan coupler represented by Formula (I) or (II), the group represented by $R_1$, $R_2$, $R_3$ or X may be a divalent group resulting from the removal of one hydrogen atom from a monovalent group thereof, and form a dimer or a polymer which is higher than a dimer or combine with a high molecular weight chain to form a homopolymer or a copolymer. A typical example of a homopolymer or copolymer formed by combining with a high molecular chain is a homopolymer or copolymer of an addition polymer ethylene type unsaturated compound having a cyan coupler group represented by Formula (I) or (II). In this case, two or more kinds of a cyan color development repetitive unit having the cyan coupler group represented by Formula (I) or (II) may be contained in the polymer and one or more kinds of a non-color developable ethylene type monomer may be contained therein as a copolymerization component. The cyan color development repetitive unit having the cyan coupler group represented by Formula (I) or (II) is represented preferably by the following Formula (P):

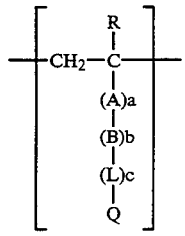

(P)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituted alkylene group, phenylene group or alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represent 0 and 1; and Q represents a cyan coupler group formed by making a hydrogen atom split off from $R_1$, $R_2$, $R_3$ or X in the compound represented by Formula (I) or (II).

Preferred as the polymer is a copolymer of a cyan color developing monomer represented by a coupler unit of Formula (I) or (II) and a non-color developable ethylene type monomer which is not capable of coupling with an oxidation product of an aromatic primary amine developing agent.

There are available as the non-color developable ethylene type monomer which is not capable of coupling with an oxidation product of an aromatic primary amine developing agent, acrylic acid, α-chloroacrylic acid, α-alkylacrylic acid (for example, methacrylic acid), an amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy metacrylate), vinyl ester (for example, vinyl acetate, vinyl propionate, and vinyl laurate), acrylonitrile, methacrylonitrile, an aromatic vinyl compound (for example, styrene and derivatives thereof, for example, vinyltoluene, divinylbenzene, vinylacetophenone, and sulfostyrene), itaconic acid, citraconic acid, crotonic acid, vinylidene chloride, vinylalkyl ether (for example, vinylethyl ether), maleic acid ester, N-vinyl-2-pyrrolidone, N-vinylpyridine, 2-vinylpyridine and 4-vinylpyridine.

Particularly preferred are acrylic acid ester, methacrylic acid ester, and maleic acid ester. The non-color developable ethylene type monomer used herewith can be used in combination of two or more kinds of monomers. For example, there can be used methyl methacrylate and butyl acrylate, butyl acrylate and styrene, butyl methacrylate and metacrylic acid, and methyl acrylate and diacetone acrylamide.

As known in the art of polymer couplers, the ethylene type unsaturated monomer which can be copolymerized with the vinyl type monomer (P) corresponding to the compound represented by Formula (I) or (II) can be selected so that the physical properties and/or chemical properties of the copolymer formed, for example, solubility, compatibility with a binder for a photographic colloid composition, such as gelatin, and flexibility and thermal stability thereof, are favorably affected.

In order to incorporate the cyan coupler of the present invention into a silver halide light-sensitive material, preferably a red-sensitive silver halide emulsion layer, it is converted preferably to a coupler-in-emulsion type coupler. For meeting this purpose, at least one of the groups represented by $R_1$, $R_2$, $R_3$ and X is preferably a so-called ballast group (preferably having 10 or more total carbon atoms, more preferably 10 to 50 total carbon atoms). In particular, $R_3$ is preferably the ballast group.

In the present invention, the cyan coupler represented by Formula (I), particularly the cyan coupler represented by Formula (I-a), is preferred in terms of the effect thereof.

Specific examples of the cyan couplers of the present invention are shown below as Compounds (1) to (60), but the present invention is not limited thereto.

(1)

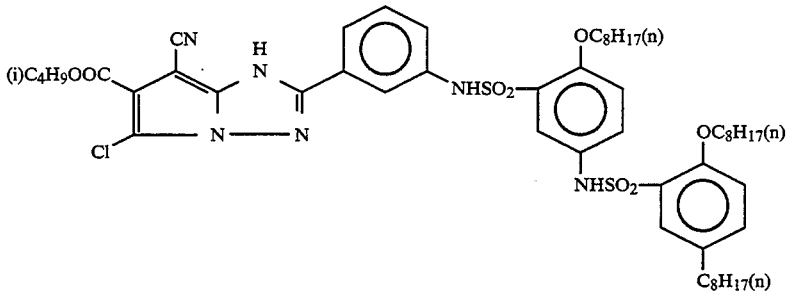

(2)

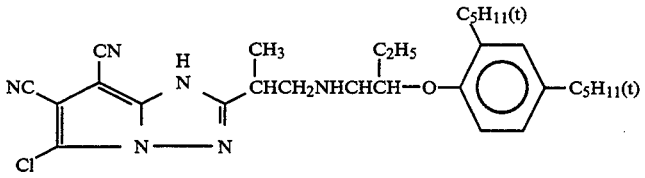

(3)

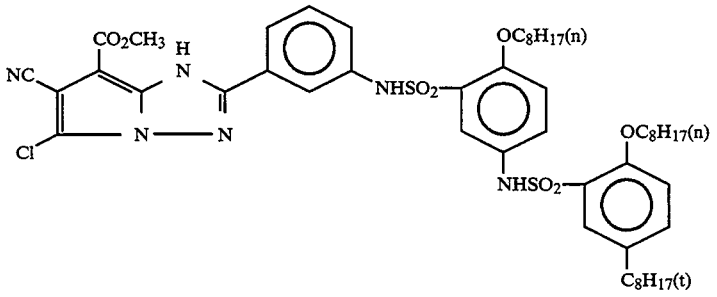

(4)

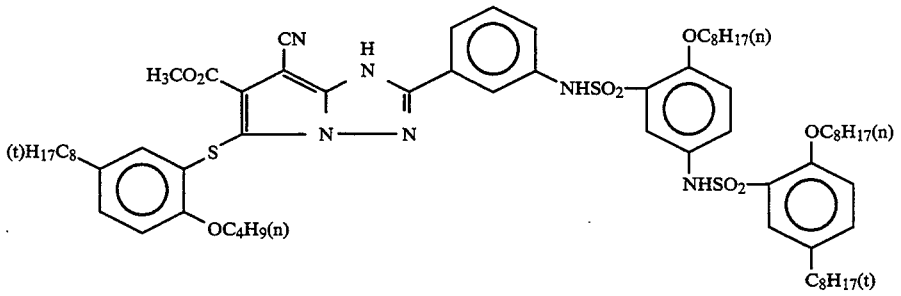

(5)

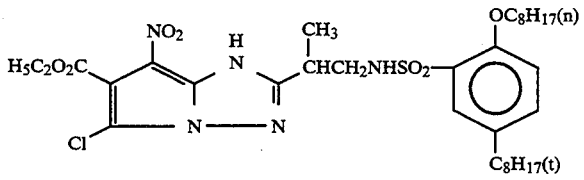

-continued
(6)
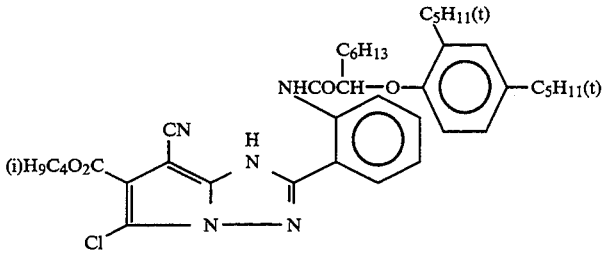
(7)
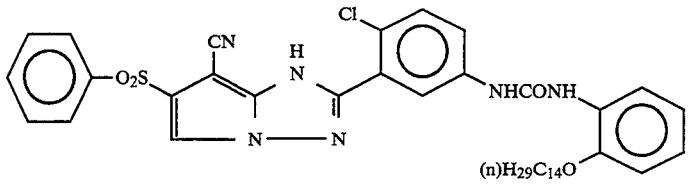
(8)
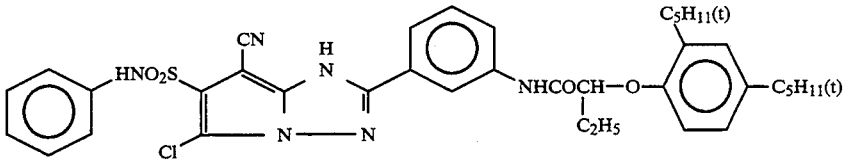
(9)
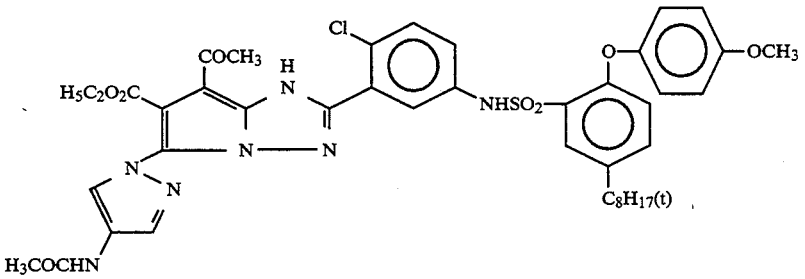
(10)
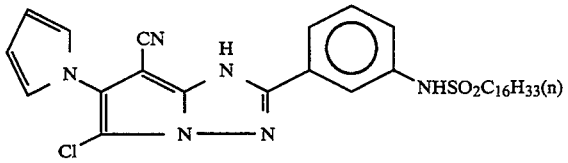
(11)
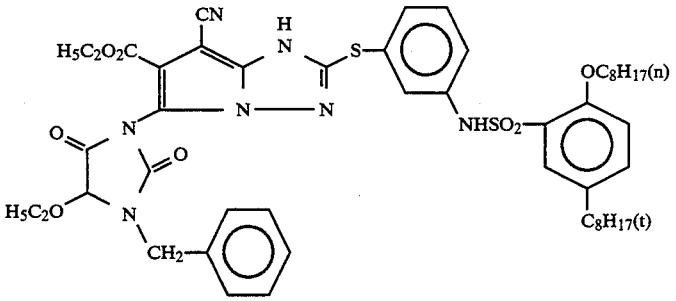

-continued
(12)
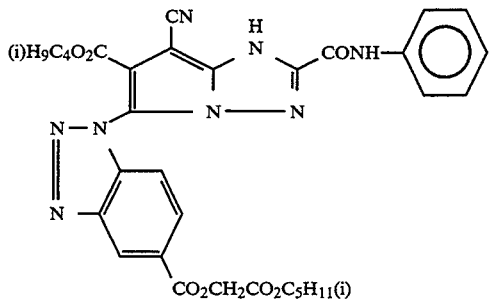
(13)
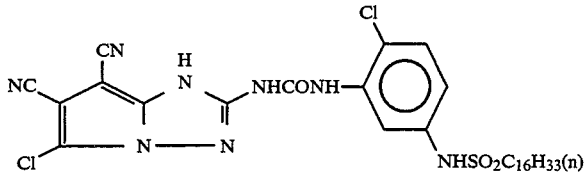
(14)
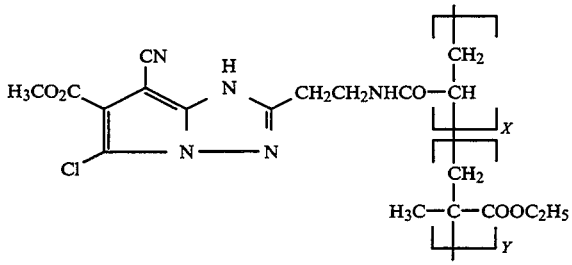
X:Y = 50:50
(15)
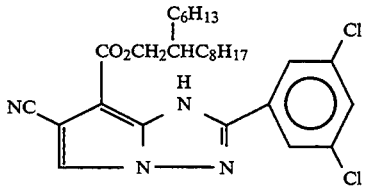
(16)
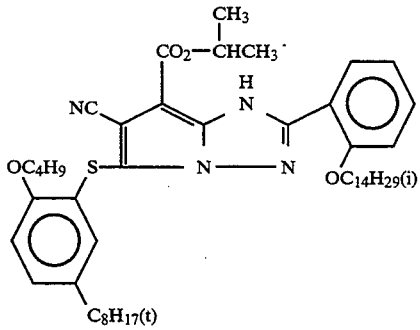
(17)
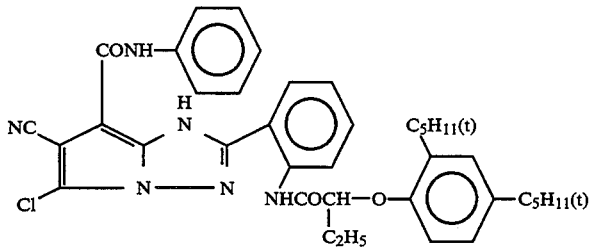

-continued
(18)
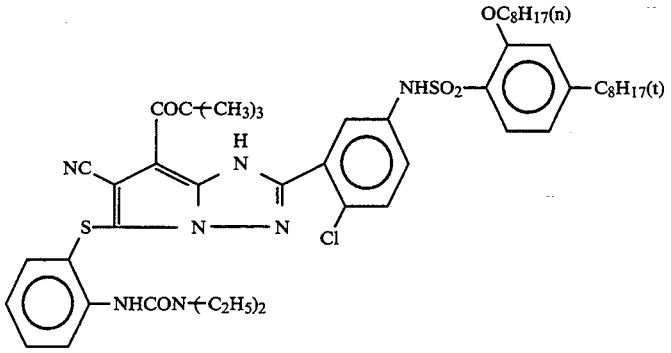
(19)
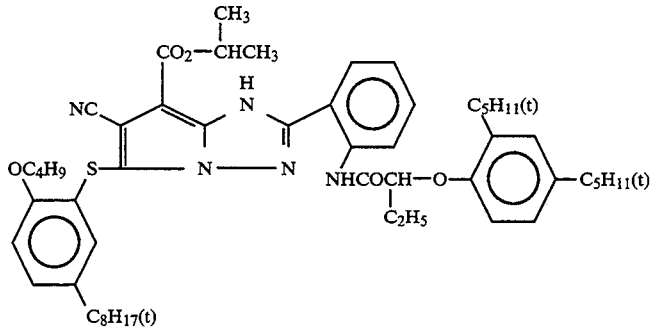
(20)
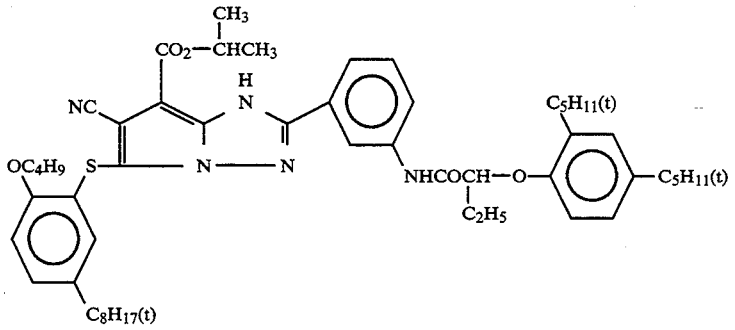
(21)
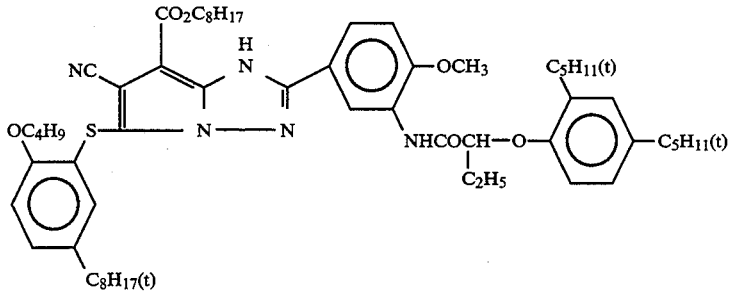
(22)
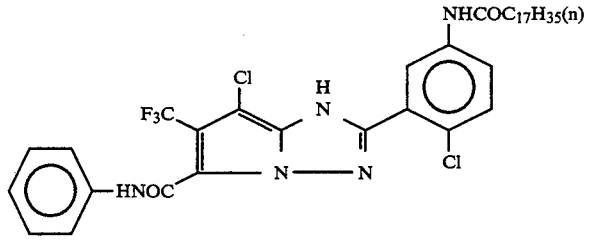

-continued
(23)
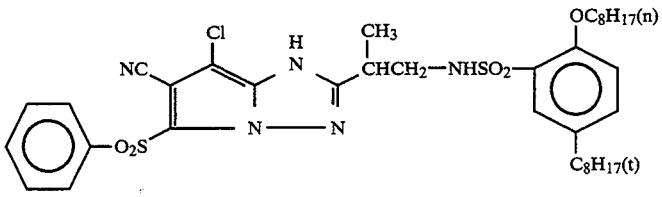
(24)
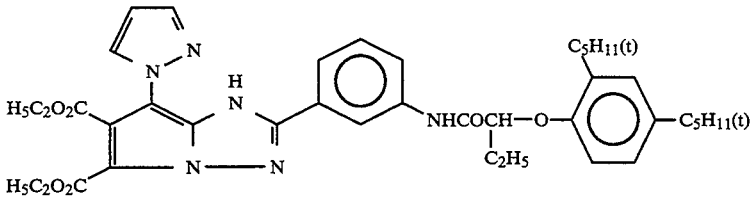
(25)
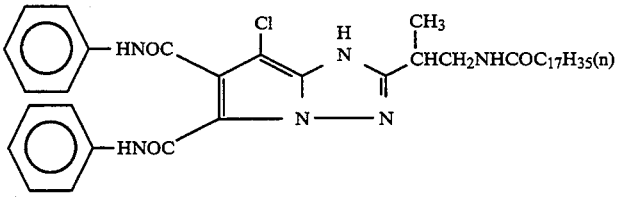
(26)
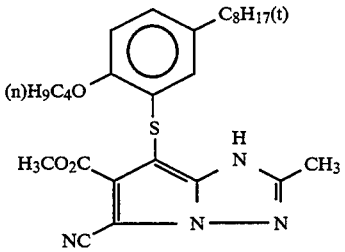
(27)
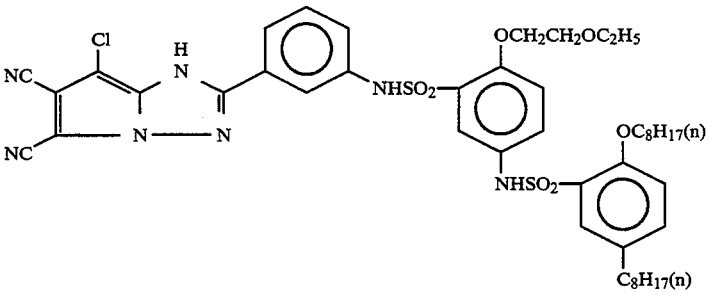
(28)
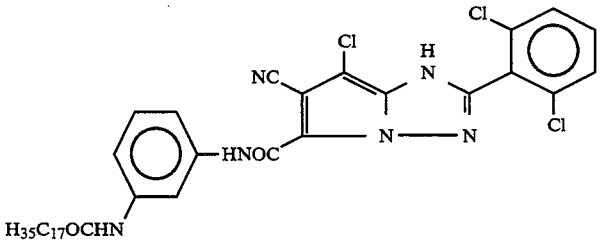
(29)
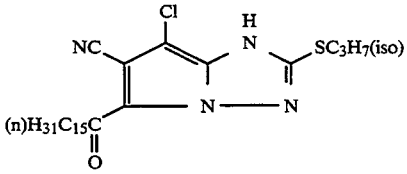

-continued
(30)
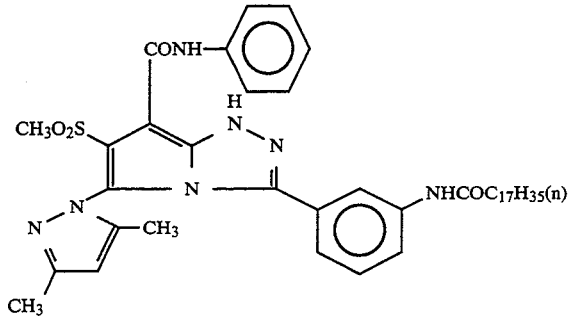
(31)
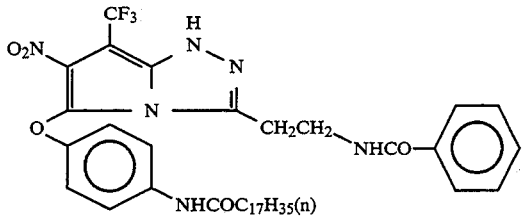
(32)
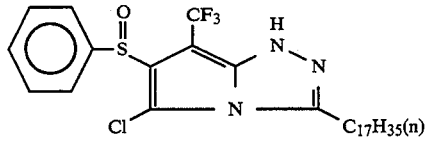
(33)
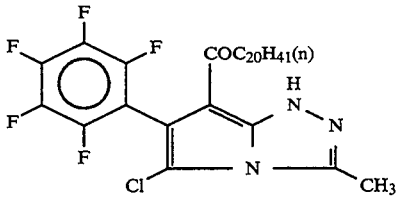
(34)
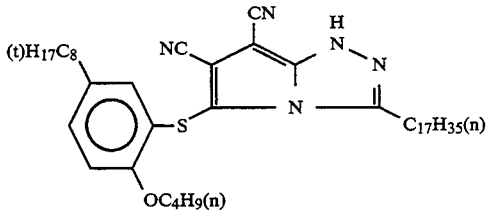
(35)
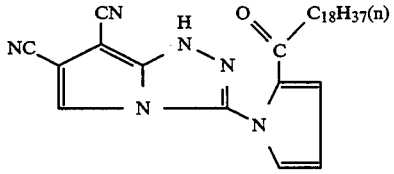
(36)
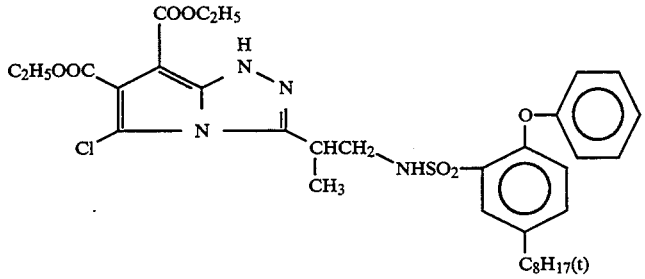

-continued
(37)
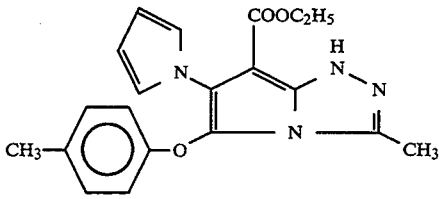
(38)
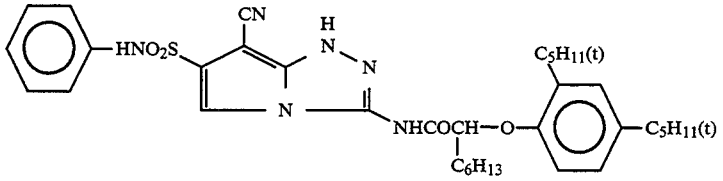
(39)
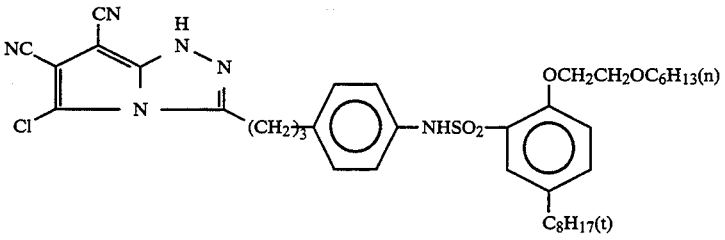
(40)
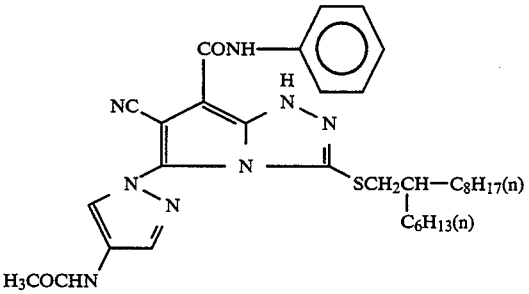
(41)
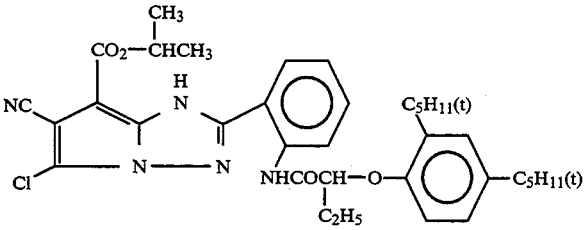
(42)
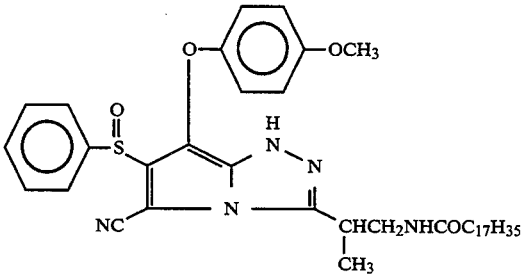
(43)
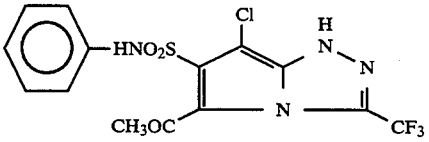

-continued
(44)
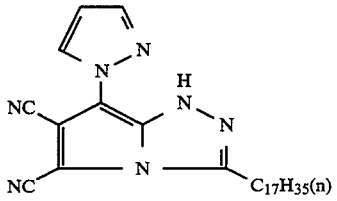
(45)
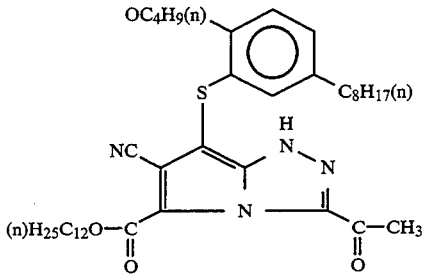
(46)
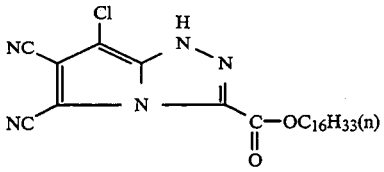
(47)
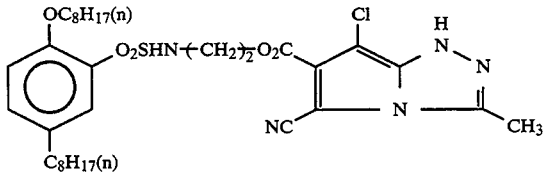
(48)
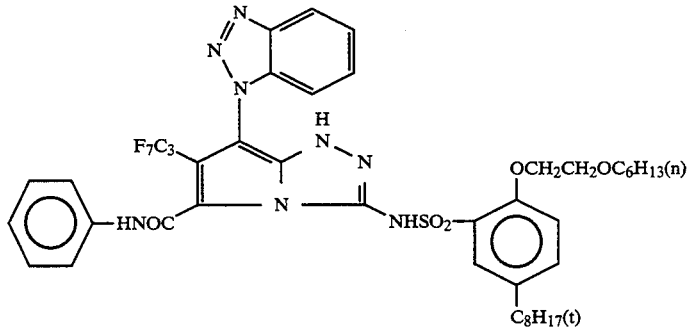
(49)
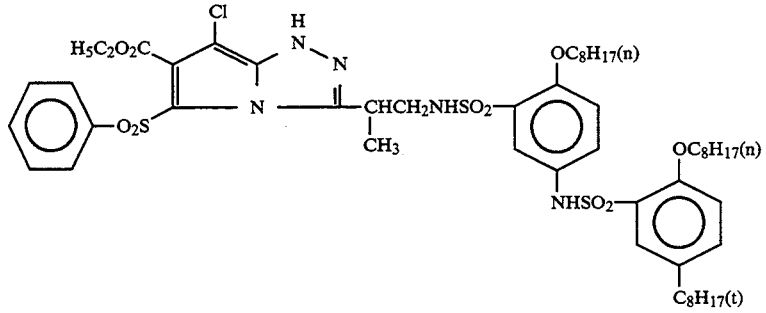

-continued
(50)
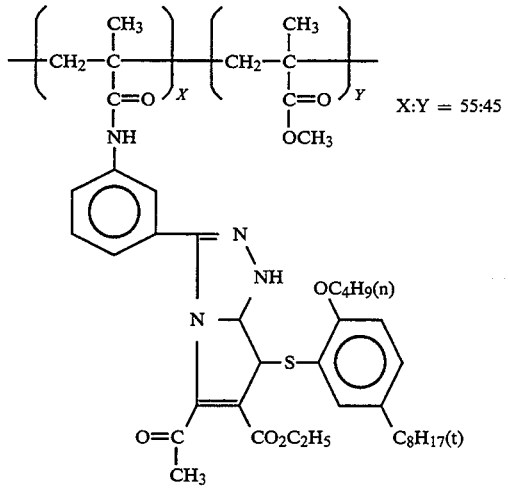
(51)
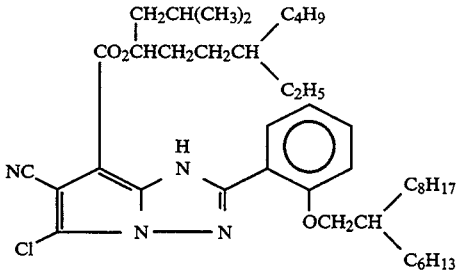
(52)
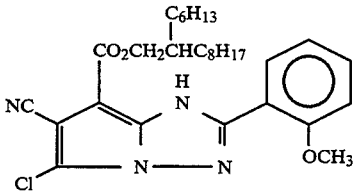
(53)
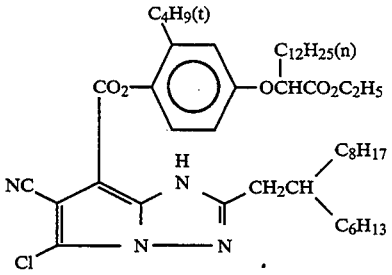
(54)
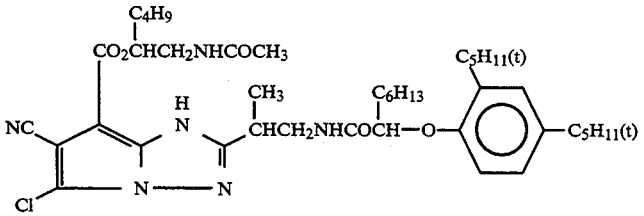

-continued
(55)
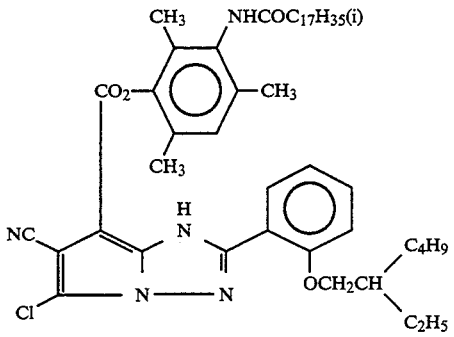
(56)
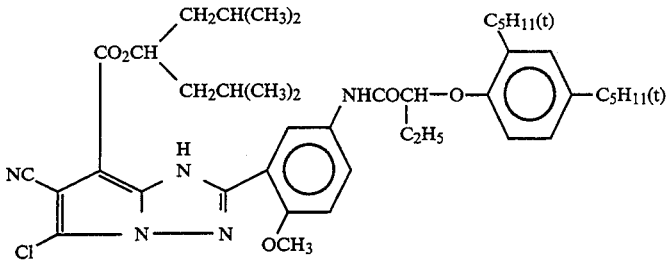
(57)
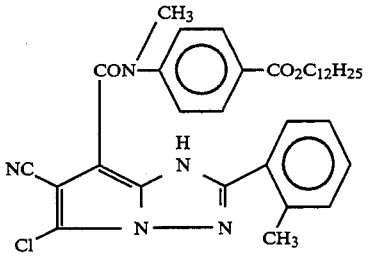
(58)
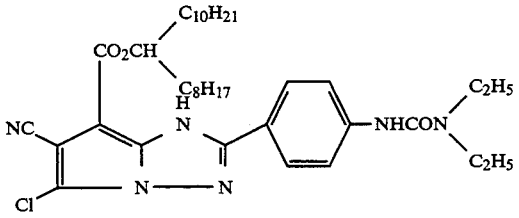
(59)
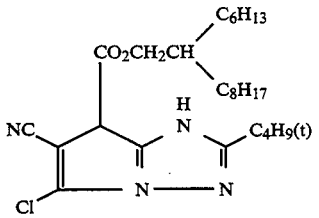
(60)
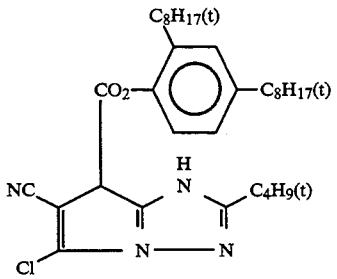
Next, the synthesis examples of the cyan couplers of the present invention will be shown in order to explain the synthesis method thereof.
Synthesis Example 1 [synthesis of Exemplified Compound (1)]

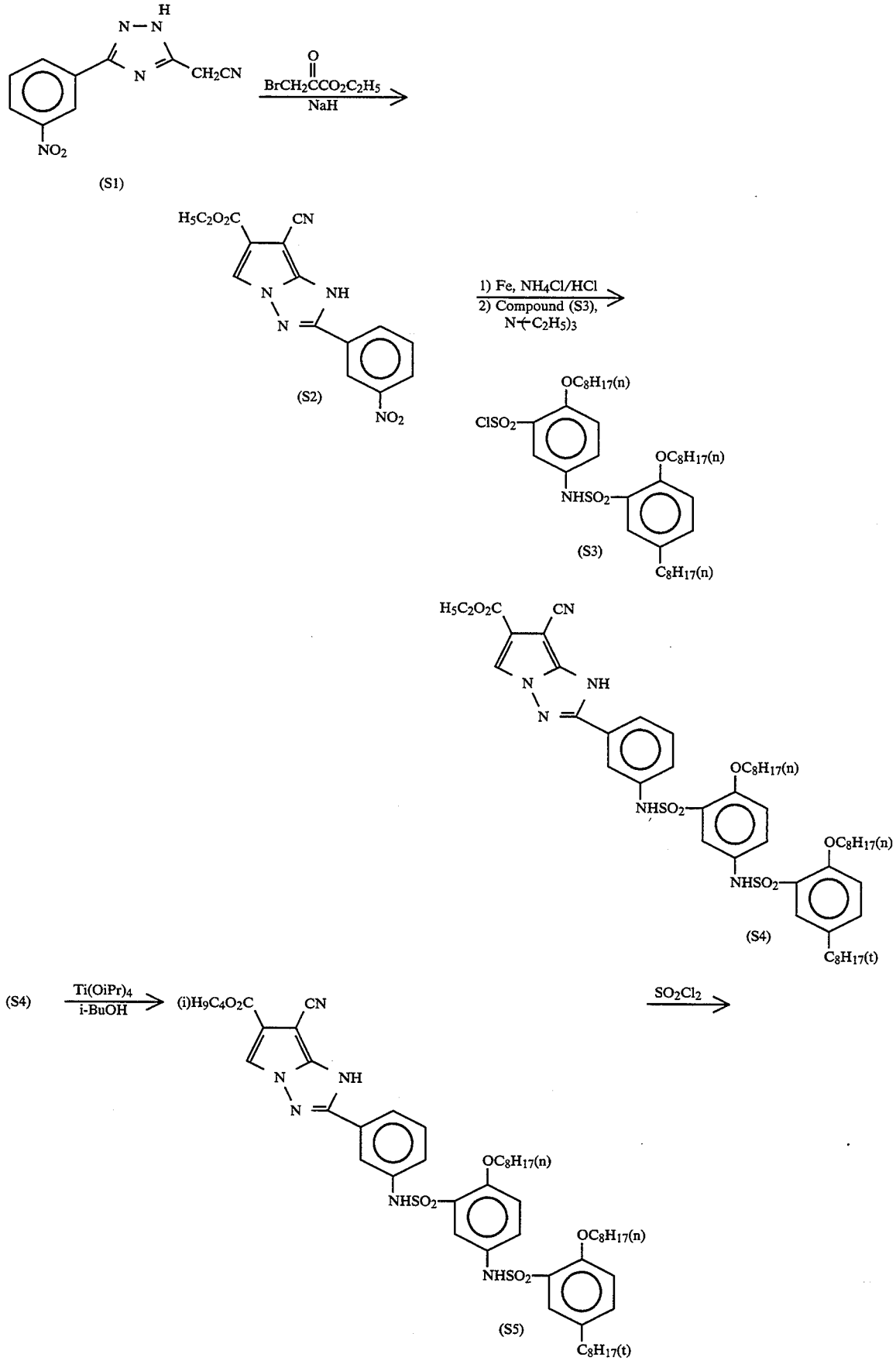
H
N—N
N
CH2CN
NO2
(S1)
O
BrCH2CCO2C2H5
NaH
H5C2O2C
CN
N
NH
N
NO2
(S2)
1) Fe, NH4Cl/HCl
2) Compound (S3),
N(C2H5)3
OC8H17(n)
ClSO2
NHSO2
OC8H17(n)
C8H17(n)
(S3)
H5C2O2C
CN
N
NH
N
NHSO2
OC8H17(n)
NHSO2
OC8H17(n)
C8H17(t)
(S4)
(S4)
Ti(OiPr)4
i-BuOH
(i)H9C4O2C
CN
N
NH
N
NHSO2
OC8H17(n)
NHSO2
OC8H17(n)
C8H17(t)
(S5)
SO2Cl2

-continued

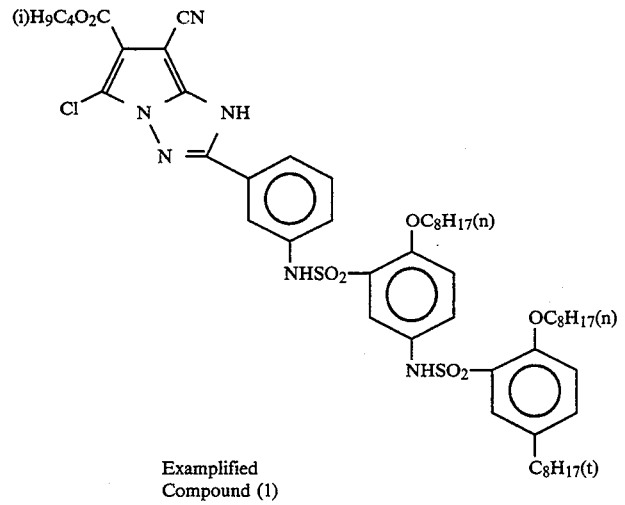

Examplified Compound (1)

There was dissolved 3-m-nitrophenyl-5-methylcyano-1,2,4-triazole (compound (S1) (20.0 g, 87.3 mmol) in dimethylacetamide (150 ml), and NaH (60% by weight in oil) (7.3 g, 183 mmol) was added thereto little by little, followed by heating to 80° C. A dimethylacetamide solution (50 ml) of ethyl bromopiruvate (13.1 ml, 105 mmol) was slowly added dropwise to the above solution. The resulting reaction solution was stirred at 80° C. for 30 minutes after the dropwise addition was completed, and then was cooled down to room temperature. Hydrochloric acid 1N then was added to the cooled reaction solution to make it acid, and then the solution was extracted with ethyl acetate. After drying on sodium sulfate, the solvent was distilled off under a reduced pressure. The residue was refined with a silica gel chromatography, whereby the compound (S2) (10.79 g) (yield 38%) was obtained.

Reduced iron (9.26 g, 166 mmol) and ammonium chloride (0.89 g, 16.6 mmol) were suspended in isopropanol (300 ml) and then, water (30 ml) and concentrated. hydrochloric acid (2 ml) were further added and the resulting solution was heated at refluxing for 30 minutes. Compound (S2) (10.79 g, 33.2 mmol) was added little by little while heating at refluxing. After heating for refluxing for a further 4 hours, the solution was immediately filtered with celite and the filtrate was subjected to a distillation under a reduced pressure. The residue was dissolved in a mixed solvent of dimethylacetamide (40 ml) and ethyl acetate (60 ml) and compound (S3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined with a silica gel chromatography, whereby compound (S4) (16.5 g) (yield: 52%) was obtained.

Compound (S4) (7.0 g, 7.30 mmol) was dissolved in isobutanol (14 ml) and tetraisopropyl orthotitanate (0.43 ml, 1.46 mmol) was added, followed by heating at refluxing for 6 hours. After the reaction solution was cooled down to room temperature, water was added thereto and the solution was extracted with ethyl acetate. The extract was dried on sodium sulfate and the solvent was distilled off under a reduced pressure. The residue was refined with a silica gel chromatography, whereby the compound (S5) (5.0 g) (yield: 69%) was obtained.

Compound (S5) (5.0 g, 5.04 mmol) was dissolved in tetrahydrofuran (50 ml), and $SO_2Cl_2$ (0.40 ml, 5.04 mmol) was added dropwise while cooling with water. After the dropwise addition was completely the solution was stirred for a further 4 hours while cooling with water. Water was added to the reaction solution and the solution was extracted with ethyl acetate. The extract was dried on sodium sulfate and the solvent was distilled off under a reduced pressure. The residue was refined with a silica gel chromatography, whereby Compound (1) of the present invention (3.9 g) (yield: 76%) was obtained.

Synthesis Example 2 (Synthesis of Exemplified Compound (39)

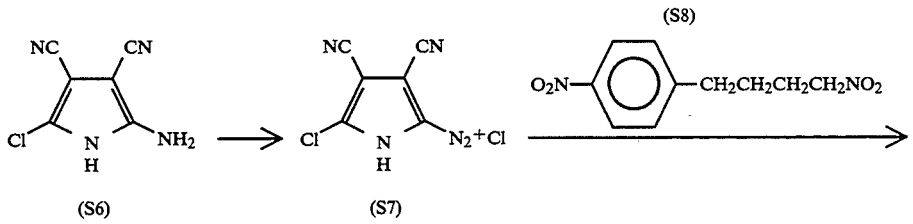

-continued

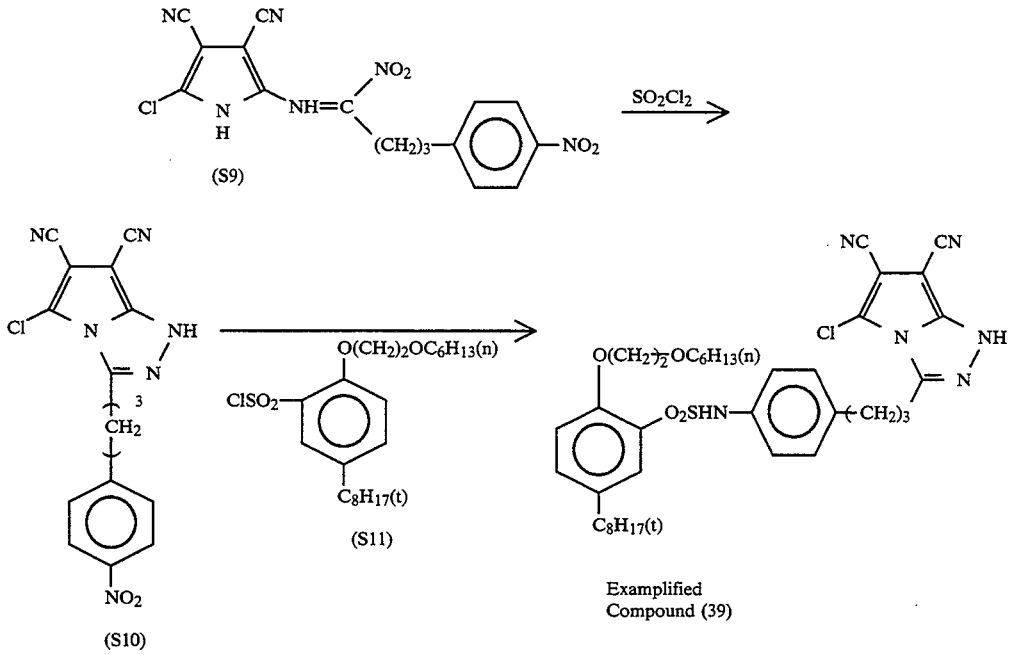

Hydrochloric acid (36% by weight) (38 ml) was added to 2-amino-5-chloro-3,4-dicyanopyrrole (compound (S6) (6.78 g, 40.7 mmol), and an aqueous solution (5.9 ml) of sodium nitrite (2.95 g, 42.7 mmol) was slowly added dropwise while stirring and cooling with ice, followed by continuing stirring for a further 1.5 hours, whereby compound (S7) was prepared. While stirring and cooling with ice, the solution of compound (S7) prepared above was slowly added dropwise to a solution prepared by adding sodium methylate (28% by weight) (102 ml) to an ethanol solution (177 ml) of compound (S8) (9.58 g, 427 mmol) while stirring and cooling with ice, and then stirring was continued for 1 hour. Next, the resulting reaction solution was heated at refluxing for 1.5 hours. Then, ethanol was distilled off from the reaction solution under a reduced pressure, and the residue was dissolved in chloroform. The solution thus prepared was washed with a saturated brine, and after drying on sodium sulfate, chloroform was distilled off under a reduced pressure. The residue was refined with a silica gel chromatography to thereby obtain compound (S10) (4.19 g) (the yield from the compounds (S6) through (S10): 29%).

Compound ($6) was synthesized as illustrated below by subjecting 3,4-dicyanopyrrole to a nitration and a reduction with iron after chlorination. Also, compound (S8 ) was synthesized from compound (a) synthesized from γ-lactone and benzene by a known method, according to the method described in *Journal of the American Chamical Society*, 76, pp. 3209 (1954).

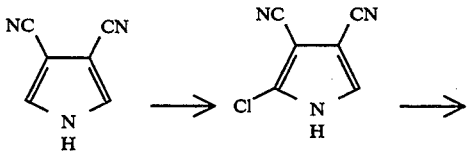

-continued

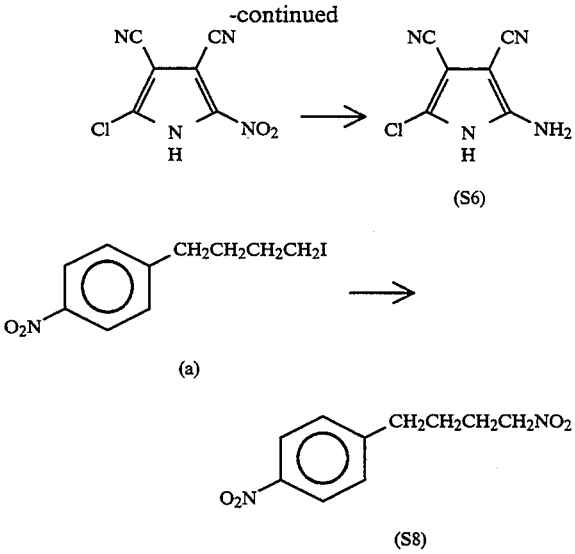

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated at refluxing for 15 minutes while stirring. Then, isopropanol (31 ml) was added thereto and the solution was heated at refluxing for a further 20 minutes while stirring. Next, an isopropanol solution (14 ml) of compound (S10) (4.1 g, 11.8 mmol) was added dropwide and the resulting reaction solution was heated at refluxing for 2 hours. Then, the reaction solution was filtered using celite as a filter aid and the residue was washed with ethyl acetate, followed by distilling the solution under a reduced pressure.

The residue was dissolved in a mixed solvent of ethyl acetate (16 ml) and dimethylacetamide (24 ml). There were added thereto compound (S11) (5.6 g, 13.0 mmol) and then triethylamine (8.2 ml, 59.0 mmol), and the solution was stirred at a room temperature for 4 hours. Water was added thereto and the solution was extracted with ethyl acetate, followed by washing the extract with a saturated brine. After drying on sodium sulfate, the solvent was distilled off under a reduced pressure and the residue was refined with a silica gel chromatography, whereby the Compound (39) of the present invention (6.46 g) (yield: 76%) was obtained.

When the cyan couplers of the present invention are applied to a light-sensitive material, they are preferably used particularly for a red-sensitive silver halide emulsion layer.

The amount of the cyan coupler of the present invention in a light-sensitive material is suitably $1\times10^{-3}$ to 1 mole, preferably $2\times10^{-3}$ to $3\times10^{-1}$ mole per mole of silver halide in the emulsion layer containing the cyan coupler.

Next, the magenta coupler represented by Formula (M) will be described in detail.

In the present invention, of the coupler structures represented by Formula (M), preferred ones are 1H-imidazo[1,2-b]pyrazole, 1H-pyrazlo[1,5-b][1,2,4]-triazole, 1H-pyrazlo[1,5-c][1,2,4]triazole, and 1H-pyrazlo[1,5-d]tetrazole. They are represented by Formulas (M-I), (M-II), (M-II) and (M-IV), respectively:

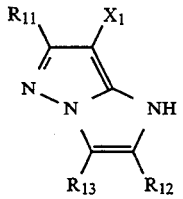
(M-I)

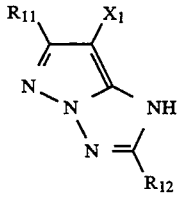
(M-II)

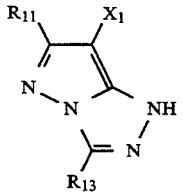
(M-III)

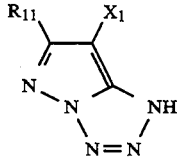
(M-IV)

There will be given detailed explanations of the substitutions $R_{10}$, $R_{11}$, $R_{12}$ and $R_{13}$, and $X_1$ in Formulas (M), (M-I), (M-II), (M-III) and (M-IV).

$R_{10}$ and $R_{11}$ each represents a hydrogen atom or a substituent such as, a halogen atom, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. $R_{10}$ and $R_{11}$ each may be a divalent group and form a bis product. Of these substituents, groups capable of further having substituents may have an organic substituent bonded via a carbon atom, an oxygen atom, a nitrogen atom or a sulfur atom, or a halogen atom.

Preferred as $R_{10}$ and $R_{11}$ each is an alkyl group, an aryl group, an alkoxy group, an aryloxy group, an alkylthio group, a ureido group, a urethane group, or an acylamino group.

$R_{12}$ has the same meaning as $R_{11}$, and thus the groups exemplified for $R_{11}$ also exemplify the groups which can be used as $R_{12}$. $R_{12}$ preferably is a hydrogen atom, an alkyl group, an aryl group, a heterocyclic group, an alkoxycarbonyl group, a carbamoyl group, a sulfamoyl group, a sulfinyl group, an acyl group, or a cyano group.

$R_{13}$ has the same meaning as $R_{11}$, and thus the groups exemplified for $R_{11}$ also exemplify the groups which can be used as $R_{13}$. $R_{13}$ preferably is a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

$X_1$ represents a hydrogen atom or a group capable of splitting off upon a reaction with an oxidation product of an aromatic primary amine color developing agent. To describe the groups $X_1$ capable of splitting off in detail, there can be given as examples, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoylamino group, a 5 or 6-membered nitrogen-containing heterocyclic group, an imido group, and an arylazo group. These groups may further be substituted with groups which are allowed as the substituents for $R_{11}$.

Besides the above groups, $X_1$ is sometimes in the form of a bis type coupler obtained by condensing a 4-equivalent coupler with aldehydes or ketones as a releasing group bonded via a carbon atom. Further, $X_1$ may contain a photographically useful group such as a development inhibitor and a development accelerator. $X_1$ is preferably a halogen atom, an alkoxy group, an aryloxy group, an alkyl- or arylthio group, or a 5 or 6-membered nitrogen-containing heterocyclic group bonded to a coupling active site via a nitrogen atom.

In the present invention, of the compounds represented by Formulas (M-I), (M-II), (M-III) and (M-IV) shown above, the pyrazolotriazole type magenta couplers represented by Formulas (M-II) and (M-III) are preferred.

In these pyrazolotriazole type magenta couplers represented by Formulas (M-II) and (M-III), it is more preferred that $R_{11}$ is an alkyl group; $R_{12}$ and $R_{13}$ each are an alkyl group or an aryl group; and $X_1$ is a chlorine atom or an aryloxy group.

There will be given more detailed explanations of preferred $R_{11}$, $R_{12}$, $R_{13}$ and $X_1$ groups in these formulas below.

$R_{11}$ preferably represents an alkyl group. To be more specific, $R_{11}$ preferably is a substituted or unsubstituted, linear, branched or cyclic alkyl group having 1 to 32 carbon atoms, an unsubstituted, linear, branched or cyclic alkyl group having preferably 1 to 30, more preferably 1 to 10 carbon atoms, and more preferably a branched alkyl group having 3 to 8 carbon atoms. There can be given as the alkyl group for $R_{11}$, methyl, ethyl, isopropyl, t-butyl, cyclohexyl, and cyclopentyl. Particularly preferred is isopropyl or t-butyl.

$R_{12}$ and $R_{13}$ each independently represents an alkyl group or an aryl group. To be more specific, $R_{12}$ and $R_{13}$ each preferably is a substituted or unsubstituted, linear, branched or cyclic alkyl group having 1 to 32 carbon atoms or a substituted or unsubstituted phenyl group. $R_{12}$ and $R_{13}$ each preferably is a substituted or unsubstituted, linear or branched alkyl group having 1 to 10 carbon atoms or a substituted phenyl group. More preferred as $R_{12}$ is an alkyl group having one or two alkyl groups as a substituent on a carbon atom bonded to a pyrazolotriazole structure, or a phenyl group having at least one acyamino group or sulfonamido group as a substituent. More preferred as $R_{13}$ is a linear substituted alkyl group having two or more carbon atoms, an alkyl group having one or two alkyl groups as a substituent on a carbon atom bonded to a pyrazolotriazole structure, or a phenyl group having at least one substituent at an ortho position to a carbon atom bonded to a pyrazlotriazole structure. Particularly preferred as $R_{12}$ is $—CH(CH_3)—NHR_{15}$, $—C(CH_3)_2CH_2NHR_{15}$ (wherein $R_{15}$ represents an acyl group or a sulfonyl group), or a phenyl group having an acylamino group or a sulfonamido group at a para position or a meta position. Particularly preferred as $R_{13}$ is $—(CH_2)_n—SO_2R_{16}$ (where n represents an integer of 2 or more and $R_{16}$ represents an unsubstituted, linear or branched alkyl group or a substituted phenyl group), $—CH(CH_3)—NHR_{17}$, $—(CH_3)_2NHR_{17}$, $—CH(CH_3)CH_2NHR_{17}$, $—C(CH_3)_2—CH_2NHR_{17}$ (where $R_{17}$ represents the same groups as those defined for $R_{15}$), or a phenyl group having alkyl groups at both ortho positions to a carbon atom bonded to a main structure and further having at least one acylamino group or a sulfonamido group at a meta position or a para position.

$X_1$ preferably represents a chlorine atom or an aryloxy group. To explain the aryloxy group represented by $X_1$ in more detail, it is preferably a substituted phenoxy group having 6 to 30 carbon atoms, more preferably a substituted phenoxy group having a substituent at the para position, particularly preferably an alkyl group substituted or unsubstituted at the para position, or a phenoxy group having an alkoxycarbonyl group or a sulfonyl group as a substituent.

The substituents the above groups $R_{11}$, $R_{12}$, $R_{13}$ and $X_1$ can have preferably are a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group.

In the present invention, of the couplers represented by Formula (M), the couplers represented by Formula (M-II) are preferred and particularly preferred are the couplers represented by Formula (M-II), in which $R_{11}$ is a branched alkyl group and $R_{12}$ is the above $—C(CH_3)_2CH_2—NHR_{15}$ or a phenyl group having an acylamino group or a sulfonamido group at a para position or a meta position.

The above-described particularly preferred couplers, when used with the cyan couplers of the present invention represented by formula (I) or (II), effectively produce the improvement in the above-described color developability, dye image fastness and color reproducibility.

Examples of the magenta couplers represented by Formula (M-II) or (M-III) are shown below, but the present invention is not limited thereto.

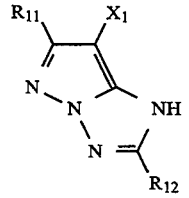

| | $R_{11}$ | $R_{12}$ | $X_1$ |
|---|---|---|---|
| M-1 | 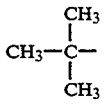 | 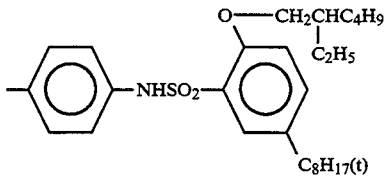 | Cl |

-continued
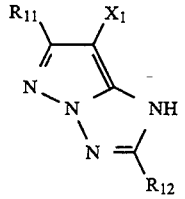
| | $R_{11}$ | $R_{12}$ | $X_1$ |
|---|---|---|---|
| M-2 | " | 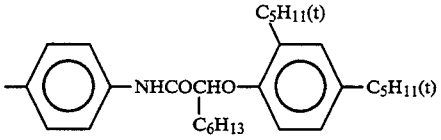 | " |
| M-3 | " | 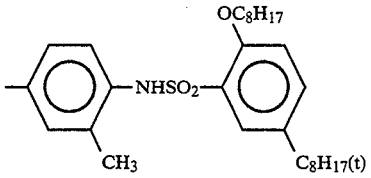 | " |
| M-4 | " | 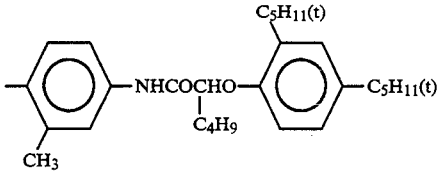 | " |
| M-5 | " | 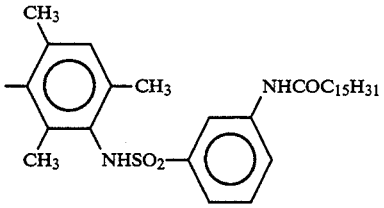 | " |
| M-6 | 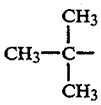 | 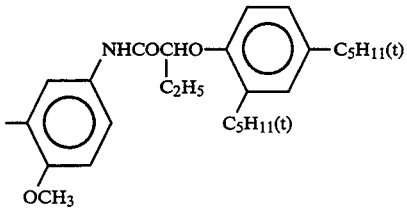 | Cl |
| M-7 | " | 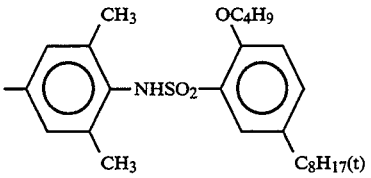 | " |
| M-8 | " | 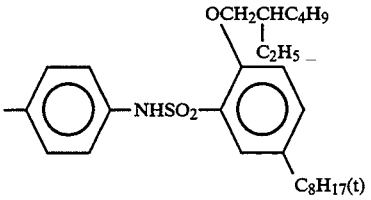 | 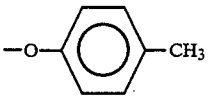 |

-continued
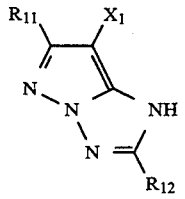
| | $R_{11}$ | $R_{12}$ | $X_1$ |
|---|---|---|---|
| M-9 | " | " | 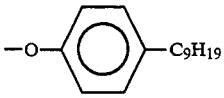 |
| M-10 | " | " | 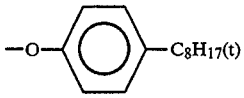 |
| M-11 | " | " | 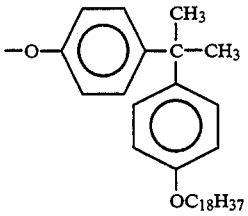 |
| M-12 | " | " | 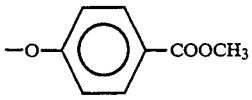 |
| M-13 | 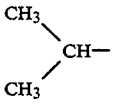 | 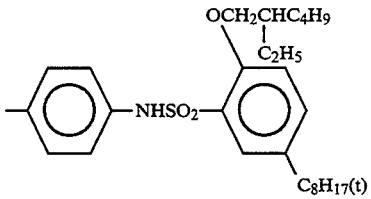 | Cl |
| M-14 | " | 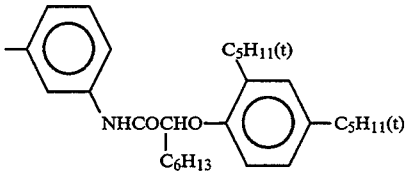 | " |
| M-15 | " | 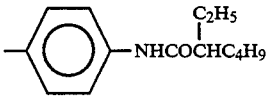 | 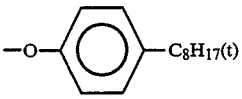 |
| M-16 | " | " | 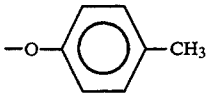 |
| M-17 | " | " | 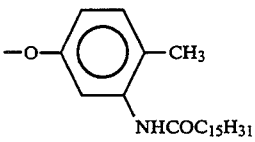 |

-continued
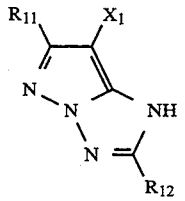
| | $R_{11}$ | $R_{12}$ | $X_1$ |
|---|---|---|---|
| M-18 | $C_2H_5$ | 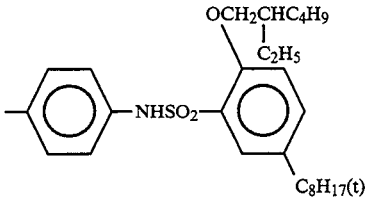 | Cl |
| M-19 | " | " | 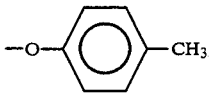 |
| M-20 | $CH_3$ | 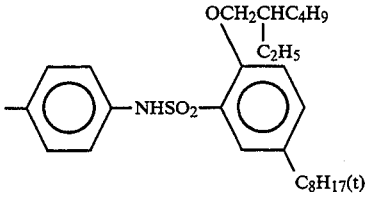 | Cl |
| M-21 | 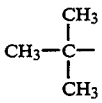 | 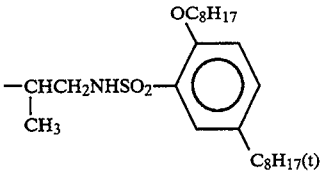 | 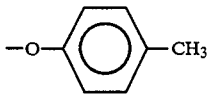 |
| M-22 | " | " | 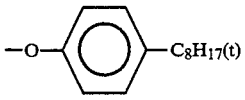 |
| M-23 | " | " | 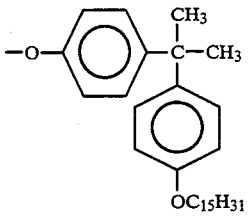 |
| M-24 | " | 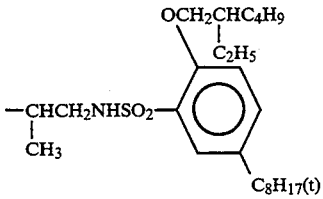 | Cl |
| M-25 | " | 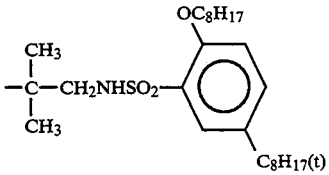 | 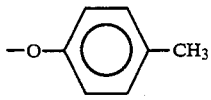 |

-continued
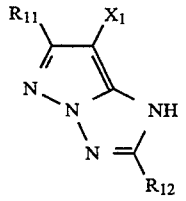
| | $R_{11}$ | $R_{12}$ | $X_1$ |
|---|---|---|---|
| M-26 | " | 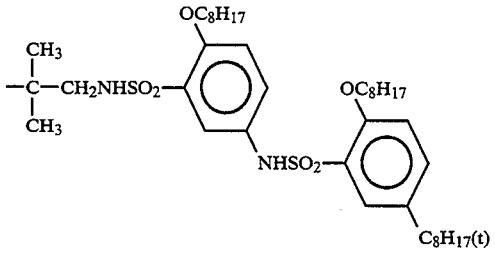 | Cl |
| M-27 | 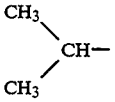 | 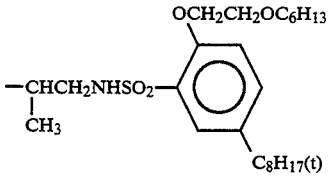 | 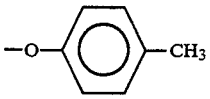 |
| M-28 | " | 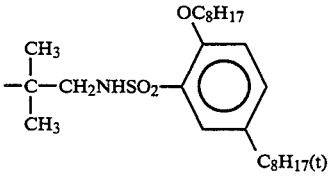 | Cl |
| M-29 | $C_2H_5$— | 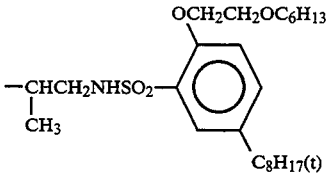 | " |
| M-30 | " | " | 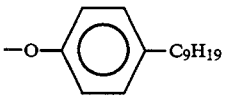 |
| M-31 | " | 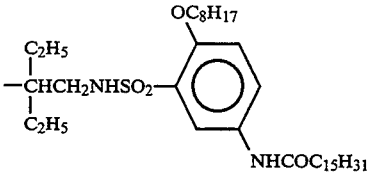 | Cl |
| M-32 | $CH_3$ | 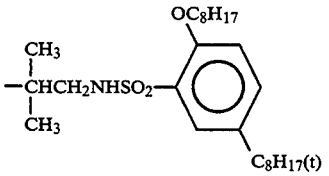 | " |

-continued
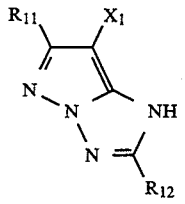
| | $R_{11}$ | $R_{12}$ | $X_1$ |
|---|---|---|---|
| M-33 | " | 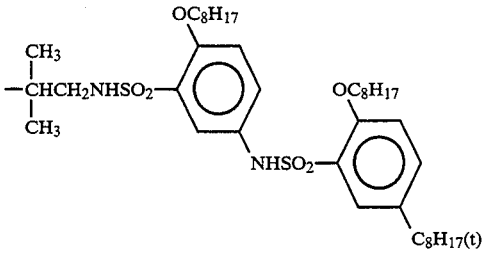 | " |
| M-34 | $C_2H_5O$— | 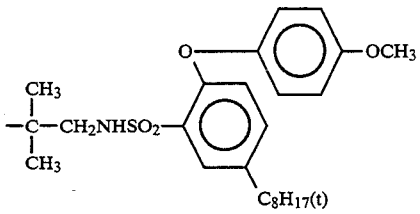 | Cl |
| M-35 | 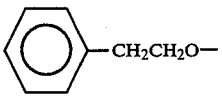 | 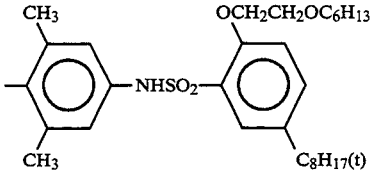 | Cl |
| M-36 | 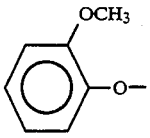 | 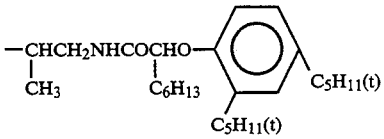 | F |
| M-37 | $CH_3CONH$— | 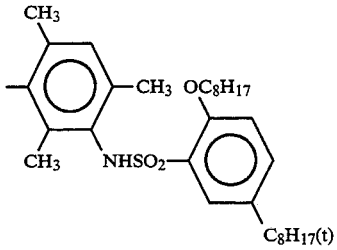 | 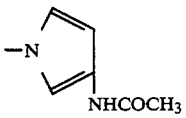 |
| M-38 | 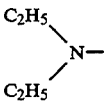 | 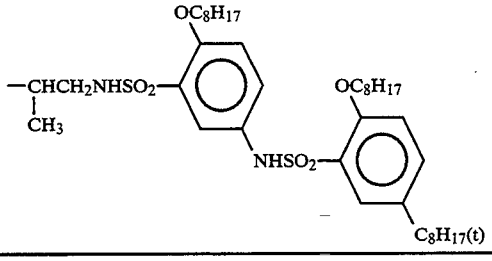 | 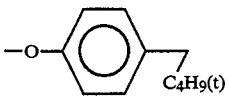 |

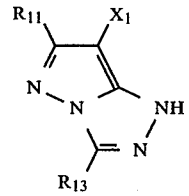
| | $R_{11}$ | $R_{13}$ | $X_1$ |
|---|---|---|---|
| m-1 | 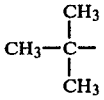 | $-(CH_2)_3SO_2C_{12}H_{25}$ | Cl |
| m-2 | " | 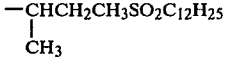 | " |
| m-3 | " | 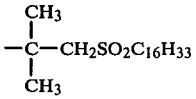 | " |
| m-4 | " | 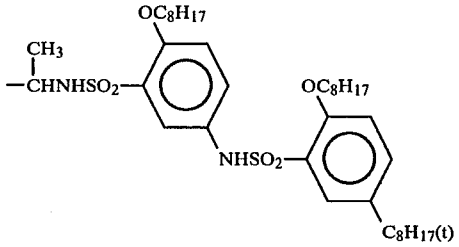 | 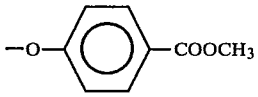 |
| m-5 | " | 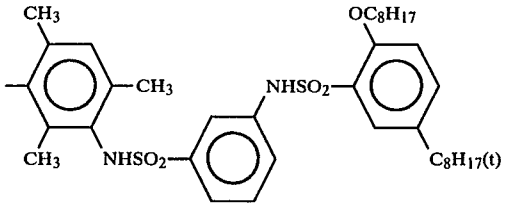 | Cl |

-continued
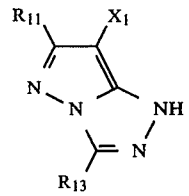
| | $R_{11}$ | $R_{13}$ | $X_1$ |
|---|---|---|---|
| m-6 | 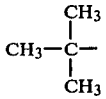 | 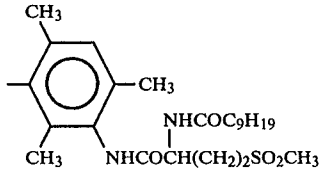 | Cl |
| m-7 | " | " | 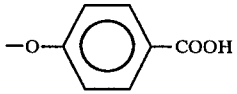 |
| m-8 | 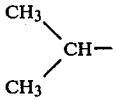 | 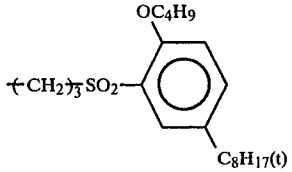 | Cl |
| m-9 | " | 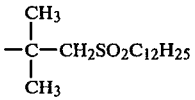 | " |
| m-10 | " | " | 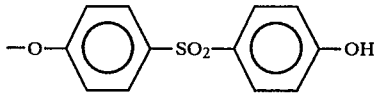 |

-continued
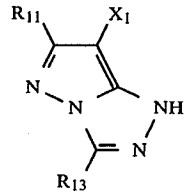
| | $R_{11}$ | $R_{13}$ | $X_1$ |
|---|---|---|---|
| m-11 | " | 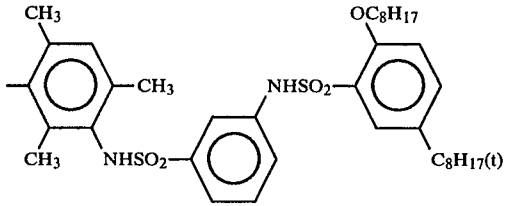 | Cl |
| m-12 | " | " | 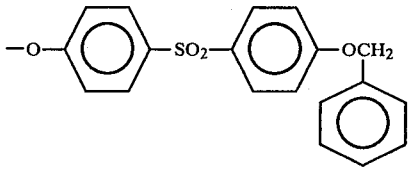 |
| m-13 | $C_2H_5$ | 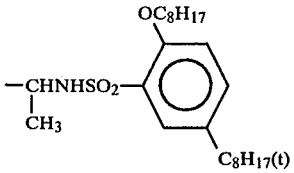 | 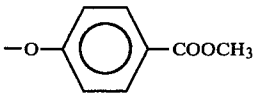 |
| m-14 | | 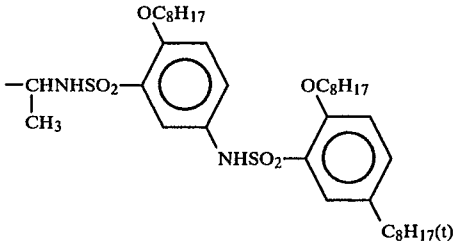 | " |

-continued
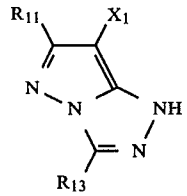
| | $R_{11}$ | $R_{13}$ | $X_1$ |
|---|---|---|---|
| m-15 | $CH_3$ | " | Cl |
| m-16 | " | 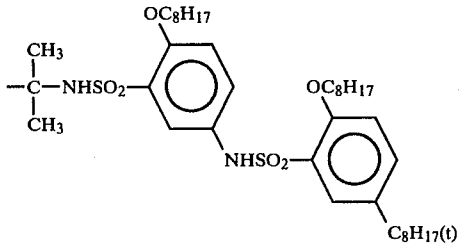 | " |
| m-17 | " | 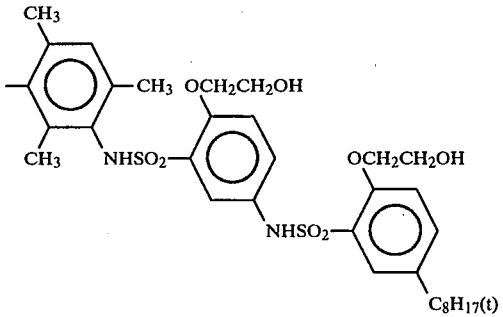 | " |
| m-18 | " | 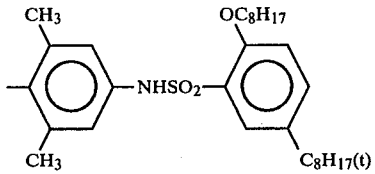 | 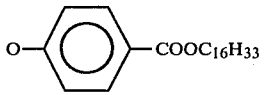 |

-continued
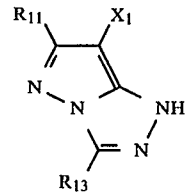
| | $R_{11}$ | $R_{13}$ | $X_1$ |
|---|---|---|---|
| m-19 | " | 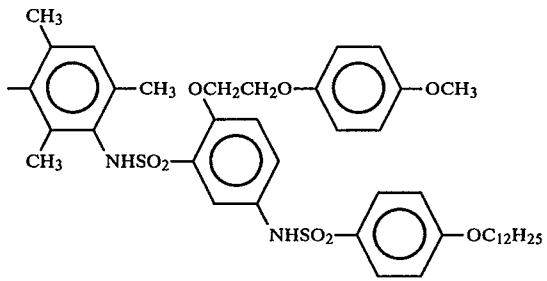 | Cl |
| m-20 | 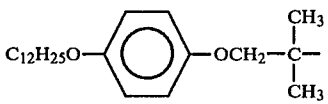 | 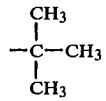 | Cl |
| m-21 | " | 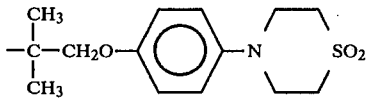 | " |
| m-22 | 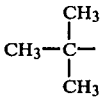 | 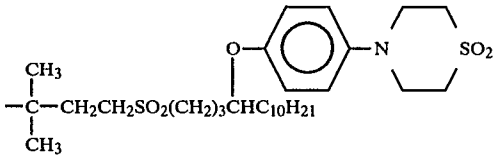 | " |

-continued
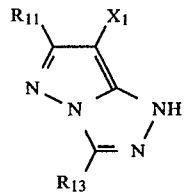
| | $R_{11}$ | $R_{13}$ | $X_1$ |
|---|---|---|---|
| m-23 | " | 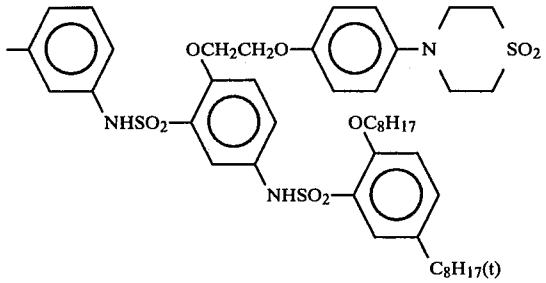 | " |
| m-24 | " | 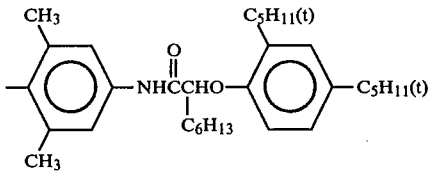 | 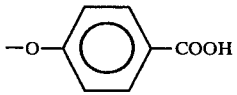 |
| m-25 | " | 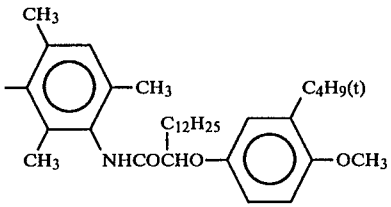 | " |

-continued
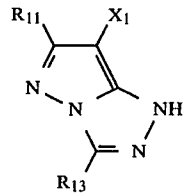
| | $R_{11}$ | $R_{13}$ | $X_1$ |
|---|---|---|---|
| m-26 | " | 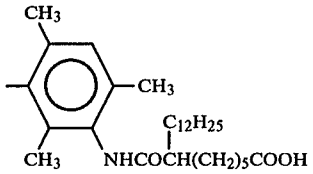 | Cl |
| m-27 | 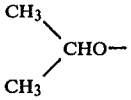 | 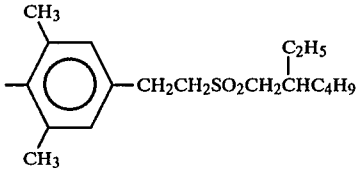 | 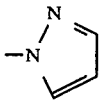 |
| m-28 | 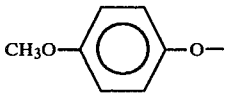 | 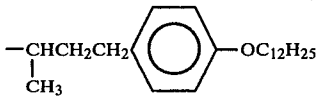 | 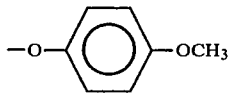 |
| m-29 | $C_2H_5OCH_2CH_2O$— | 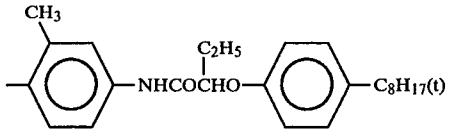 | Cl |

-continued
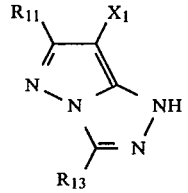
| | $R_{11}$ | $R_{13}$ | $X_1$ |
|---|---|---|---|
| m-30 | $C_2H_5S$— | 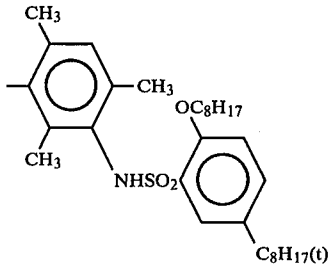 | Cl |
| m-31 | $C_2H_5NHCONH$— | 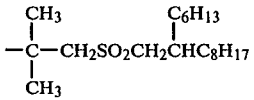 | 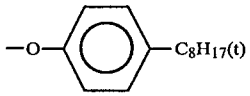 |
| m-32 | 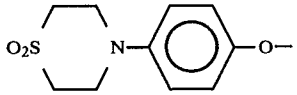 | 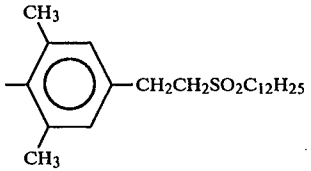 | 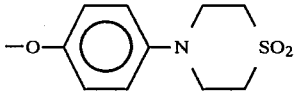 |

The compounds represented by Formula (M-II) can be synthesized by the method described in U.S. Pat. No. 4,500,630, the compounds represented by Formula (M-III) by the methods described in U.S. Pat. Nos. 4,540,654 and 4,705,863, and JP-A-61-65245, JP-A-62-209457, and JP-A-62-249155.

When the magenta couplers of the present invention are applied to a light-sensitive material, they are particularly preferably applied to a green-sensitive silver halide emulsion layer.

The amount of magenta couplers of the present invention in a light-sensitive material is suitably $1\times10^{-3}$ to 1 mole, preferably $2\times10^{-3}$ to $3\times10^{-1}$ mole per mole of silver halide in the emulsion layer containing the magenta coupler.

The magenta couplers of the present invention may be used as a mixture of two or more kinds, or the same coupler may be divided into two or more parts and used in two or more layers. Further, they may be used in combination with conventional magenta couplers as long as the effects of the present invention are demonstrated.

The cyan couplers and magenta couplers of the present invention can be introduced into a light-sensitive material by various conventional dispersing methods. Preferred is an oil-in-water dispersion method in which they are dissolved in a high boiling solvent (a low boiling solvent is used in combination according to necessity) and are emulsified and dispersed in a gelatin aqueous solution which can be added to a silver halide emulsion.

Examples of the high boiling solvent used in the oil-in-water dispersion method are described in U.S. Pat. No. 2,322,027.

There can be given examples as of the high boiling organic solvent which be used can in the above oil-in-water dispersion method, phthalic acid esters (for example, dibutyl phthalate, dioctyl phthalate, dicyclohexyl phthalate, di-2-ethylhexyl phthalate, decyl phthalate, bis(2,4-di-tert-amylphenyl)isophthalate, and bis(1,1-diethylpropyl)phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), aniline derivatives (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, diisopropylnaphthalene, phenols (for example, 2,4-di-tert-amylphenol, 4-dodecylphenol, 4-dodecyloxycarbonylphenol, and 4-(4-dodecyloxyphenylsulfonyl)phenol), carboxylic acids (for example, 2-(2,4-di-tert-amylphenoxy)butyric acid, and 2-ethoxyoctanedecanoic acid), and alkylphosphoric acids (for example, di-2(ethylhexyl)phosphoric acid and diphenylphosphoric acid). Further, there may be used in combination as an auxliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling solvents can be used in an amount of 0 to 2.0 times, preferably 0 to 1.0 times by weight of a coupler.

The couplers of the present invention can also be incorporated into the light-sensitive material by a latex dispersing methods. Examples of polymer dispersing methods and examples of a latex for impregnation are described in U.S. Pat. No. 4,199,363, German Patent Applications (OLS) 2,541,274 and 2,541,230, JP-B-53-41091, and European Patent Application 029104. Further a dispersion method by an organic solvent-soluble polymer is described in PCT International Patent Publication W088/00723.

The light-sensitive material of the present invention may comprise at least one silver halide emulsion layer containing the cyan coupler of the present invention, at least one silver halide emulsion layer containing the magenta coupler of the present invention, and at least one silver halide emulsion layer containing a yellow coupler, provided on a support. In a conventional light-sensitive material, a silver halide emulsion layer containing a cyan coupler is red-sensitive, a silver halide emulsion layer containing a magenta coupler is green-sensitive, and a silver halide emulsion layer containing a yellow coupler is blue-sensitive. Also in the present invention, the light-sensitive material can be of the constitution in which at least one blue-sensitive silver halide emulsion layer, at least one green-sensitive silver halide emulsion layer containing the magenta coupler of the present invention, and at least one red-sensitive silver halide emulsion layer containing the cyan coupler of the present invention are provided on a support in this order, but the order may be different from this. Further, an infrared-sensitive silver halide emulsion layer can replace at least one of the above light-sensitive layers. Also, a layer may consist of two or more layers each having the same color sensitivity.

For the purpose of improving sharpness of an image, there are preferably incorporated into a hydrophilic colloid layer of the light-sensitive material according to the present invention so that the optical reflection density of the light-sensitive material in 680 nm becomes 0.70 or more, dyes (among them, an oxonol type dye) capable of being decolored by processing, described at pages 27 to 76 of European Patent EP 0,337,490A2, and into a water resisting resin layer of a support, titanium oxide which is subjected to a surface treatment with di- to tetrahydric alcohols (for example, trimethylolethane) in a proportion of 12% by weight or more (more preferably 14% by weight or more).

Gelatin usually contains therein a substantial amount of calcium ions and the content thereof can reach 5000 ppm or more in many cases. Accordingly, deionized gelatin containing calcium ions in an amount of 5000 ppm or less is preferably used in the present invention. The deionized gelatin is used preferably in an amount of 10% by weight or more, more preferably 20% by weight or more and particularly preferably 50% by weight or more, based on the total amount of gelatin.

Also, in the light-sensitive material according to the present invention, the color image preservability-improving compounds described in European Patent 0,277,589A2 are preferably used together with couplers.

In particular, they are preferably used in combination with the magenta coupler represented by Formula (M).

Preferably used simultaneously or singly for preventing side effects of, for example, the generation of stain due to the reaction of a color developing agent or an oxidation product thereof remaining in a layer during storage after processing with a coupler are compounds (A) described in European Patent EP 0,277,589A2, which chemically combine with an aromatic amine type developing agent remaining after color development processing to form a chemically inactive and substantially colorless compound, and/or the compounds (B) described in European Patent EP 0,277,589A2, which chemically combine with the oxidation product of an aromatic amine type developing agent remaining after color development processing to form a chemically inactive and substantially colorless compound.

Further, anti-mold agents such as described in JP-A-63-271247 are preferably added to the light-sensitive material according to the present invention for the purpose of preventing various molds and bacteria which grow in a hydrophilic colloid layer to deteriorate an image.

There may be used as a support for the light-sensitive material according to the present invention for display, a white color polyester type support or a support in which a layer containing a white pigment is provided on a support side having a silver halide emulsion layer. An anti-halation layer is preferably provided on a support side coated thereon with a silver halide emulsion layer or the backside thereof in order to further improve sharpness. In particular, the transmission density of a support is controlled preferably to be 0.35 to 0.8 so that a display can be viewed with either a reflected light or a transmitted light.

The light-sensitive material according to the present invention may be exposed with either a visible ray or an infrared ray. The method of exposure may be either a low illuminance exposure or a high illuminance and short time exposure. Particularly in the latter case, preferred is a laser scanning exposing method in which the exposing time per picture element is shorter than $10^{-4}$ second.

During exposure, a band stop filter described in U.S. Pat. No. 4,880,726 is preferably used, whereby a light mixture is removed to notably improve color reproduction.

The light-sensitive material of the present invention is subjected to an imagewise exposure and then to processing with a bleach-fixing solution after color developing, followed by a rinsing and/or stabilizing processing. In the present invention, the pH of the bleach-fixing solution used above generally is 3.5 to 6.5, preferably 4.0 to 6.0.

The method described in a left upper column at page 27 to a right upper column at page 34 of JP-A-2-207250 is preferred for processing a silver halide color photographic light-sensitive material in which a high silver chloride emulsion having a silver chloride content of 90 mole% or more is used.

Preferred silver halide emulsions, other materials (additives), photographic constitutional layers (layer arrangements), processing method, and additives for processing for use with the photographic material of the present invention include those described in the following patent publications, particularly European Patent EP 0,355,660A2.

TABLE 1-5

| Photographic element | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, line 2 to 5. | p. 45, line 53 to p. 47, line3, and p. 47, line 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, line 4 to 9. |
| Spectral sensitizer (spectral sensitizing method) | p. 22, right upper column, line 8 from bottom to p. 38, last line. | p. 30, left upper column, line 1 to 13. | p. 47, line 10 to 15. |
| Emulsion stabilizer | p. 39, left upper column, line 1 to p. 72, right upper column, last line. | p. 30, left upper column, line 14 to right upper column, line 1. | p. 47, line 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, line 15 to 27, p. 5, line 30 to p. 28, last line, and p. 47, line 23 to p. 63, line 50. |
| Color forming accelerator | p. 121, left upper column, line 7 to p. 125, right | — | — |

TABLE 1-5-continued

| Photographic element | JP-A-62-215272 | JP-A-2-33144 | EP 0355660A2 |
|---|---|---|---|
| | upper column, line 1. | | |
| UV absorber | p. 125, right upper column, line 2 to p. 127, left lower column, last line. | p. 37, right lower column, line 14 to p. 38, left upper column, line 11. | p. 65, line 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, lines 33 to 40, and p. 65, line 2 to 21. |
| High boiling and/or low boiling organic solvent | p. 137, left lower column, line 9 to p. 144, right upper column, last line. | p. 35, right lower column, line 14 to p. 36, left upper, line 4. | p. 64, line 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, line 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, line 1 to 15. | p. 45, line 41 to 52 |
| Dye | p. 156, right lower column, line 15 to p. 184, right lower column, last line. | p. 38, left upper column, line 12 to right upper column, line 7. | p. 66, line 18 to 22. |
| Anti-color mixing agent | p. 185, left upper column, line 1 to p. 188, right lower column, line 3. | p. 36, right upper column, line 8 to 11. | p. 64, line 57 to line 1. |
| Gradation controller | p. 188, right lower column, line 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (antielectrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic colloid) | p. 222, left lower column, line 6 to p. 225, left upper column, last line | p. 38, right upper column, line 8 to 18. | p. 66, line 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing | p. 3, right upper column, line 7 to P. 10, right upper column, line 5. | p. 39, left upper column, line 4 to p. 42, left upper column, last line. | p. 67, line 14 to p. 69, line 28. |

TABLE 1-5-continued

| Photographic element | JP-A-62-215272 | JP-A-2-33144 | EP 0355660A2 |
|---|---|---|---|
| steps and additives) | | | |

Remarks:
1. There is included in the cited items of JP-A-62-215272, the subject matter amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

There can be used as the silver halide used in the present invention, silver chloride, silver bromide, silver bromochloride, silver bromochloroiodide, and silver bromoiodide. Particularly for the purpose of a rapid processing, preferably used is silver chlorobromide containing substantially no silver iodide and having a silver chloride content of 90 mole % or more, more preferably 95 mole % or more, and particularly 98 mole % or more, or pure silver chloride.

The present invention can be applied to, for example, a color paper, a color reversal paper, a direct positive color light-sensitive material, a color negative film, a color positive film, and color reversal film. Above all, it is preferably applied to a color light-sensitive material having a reflective support (for example, a color paper and a color reversal paper), and particularly preferably applied to the color light-sensitive material having a reflective support.

The present invention will be explained below with reference to the following examples, but is not limited thereto.

EXAMPLE 1

A paper support laminated on both sides thereof with polyethylene, which was subjected to a corona discharge treatment, was provided with a gelatin subbing layer containing sodium dodecylbenzenesulfonate, and further was coated with the various photographic constitutional layers, whereby a multilayered color photographic paper (Sample 101) having the following layer constitution was prepared. The coating solutions were prepared in the following manner.

Preparation of the first layer coating solution

A yellow coupler (ExY) (153.0 g), a dye image stabilizer (Cpd-1) (15.0 g), a dye image stabilizer (Cpd-2) (7.5 g), and a dye image stabilizer (Cpd-3) (16.0 g) were dissolved in a solvent (Solv-1) (25 g), a solvent (Solv-2) (25 g) and ethyl acetate (180 ml), and this solution was dispersed in a 10% aqueous gelatin solution (1000 g) containing a 10% sodium dodecylbenzenesulfonate aqueous solution (60 ml) and citric acid (10 g), to thereby prepare an emulsified dispersion A.

Meanwhile, there was prepared a silver bromochloride emulsion A (cube, a 3:7 mixture by Ag mole ratio of a large size emulsion A with an average grain size of 0.88 μm and a small size emulsion A with an average grain size of 0.70 μm, wherein the variation coefficients in the grain size distributions were 0.08 and 0.10, respectively, and both size emulsions contained grains in which AgBr 0.3 mol % was localized on a part of the surface thereof). Added to this emulsion were the following blue-sensitive sensitizing dyes A and B each in an amount of $2.0\times10^{-4}$ mole per mole of silver to the large size emulsion A and each in an amount of $2.5\times10^{-4}$ mole per mole of silver to the small size emulsion A. Further, this emulsion was subjected to a chemical ripening after adding a sulfur sensitizer and a gold sensitizer. The foregoing emulsified dispersion A and the red-sensitive silver bromochloride emulsion A were mixed and dissolved, whereby a first layer coating solution was prepared so that it was of the following composition.

Preparation of the fifth layer coating solution

Ethyl acetate (60.0 ml) was added to a cyan coupler (ExC) (34.0 g), a UV absorber (UV-2) (18.0 g), a dye image stabilizer (Cpd-1) (30.0 g), a dye image stabilizer (Cpd-9) 15.0 g, a dye image stabilizer (Cpd-10) (15.0 g), a dye image stabilizer (Cpd-11) (1.0 g), a dye image stabilizer (Cpd-8) (1.0 g), a dye image stabilizer (Cpd-6) (1.0 g), a solvent (Solv-6) (68.0 g), and a solvent (Solv-1) (2.0 g) to dissolve them. This solution was added to 500 ml a 20% aqueous gelatin solution containing sodium dodecylbenzenesulfonate (8 g), and then was dispersed with a supersonic homogenizer to thereby prepare an emulsified dispersion C.

Meanwhile, there was prepared a silver bromochloride emulsion C (cube, a 1:4 mixture by Ag mole ratio of a large size emulsion C with an average grain size of 0.50 μm and a small size emulsion C with an average grain size of 0.41 μm, wherein the variation coefficients in the grain size distributions were 0.09 and 0.11, respectively, and both size emulsions contained grains in which AgBr 0.8 mol % was localized on a part of the surface thereof). Added to this emulsion C was the following red-sensitive sensitizing dye E in an amount of $0.9\times10^{-4}$ mole per mole of silver to the large size emulsion C and in amount of $1.1\times10^{-4}$ mole per mole of silver to the small size emulsion C. Further, the following compound F was added in an amount of $2.6\times10^{-3}$ mole per mole of silver halide. Also, this emulsion C was subjected to a chemical ripening after adding a sulfur sensitizer and a gold sensitizer. The foregoing emulsified dispersion C and the red-sensitive silver bromochloride emulsion C were mixed and dissolved, whereby a fifth layer coating solution was prepared so that it was of the following composition.

The coating solutions for the 2nd layer to 4th layer, the 6th layer and the 7th layer were prepared in a manner similar to the 1st layer coating solution. Sodium 1-oxy-3,5-dichloro-s-triazine was used as the hardener for the respective layers.

Further, Cpd-14 and Cpd-15 were added to the respective layers so that the whole amounts thereof became 25.0 mg/m$^2$ and 50.0 mg/m$^2$, respectively.

The spectral sensitizing dyes which were used for the silver bromochloride emulsions contained in the respective light-sensitive emulsion layers are as follows:

Blue-sensitive emulsion layer
Sensitizing dye A

-continued

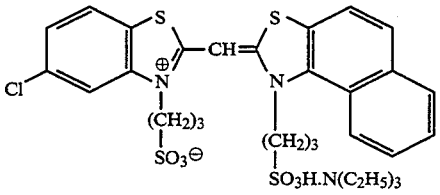

and
Sensitizing dye B

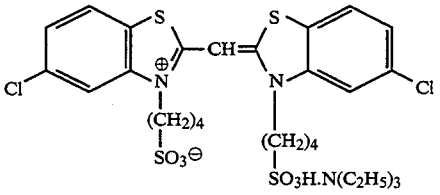

Green-sensitive emulsion layer
Sensitizing dye C

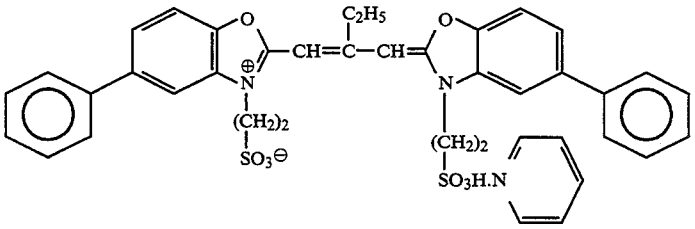

($4.0\times10^{-4}$ mole per mole of silver halide to a large size emulsion B (described below) and $5.6\times10^{-4}$ mole per mole of silver halide to a small size emulsion B described below), and Sensitizing dye D -continued

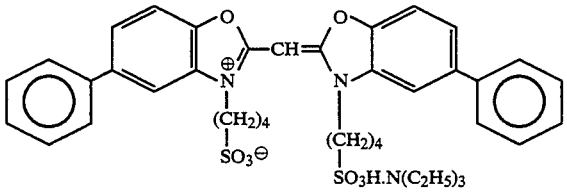

($7.0\times10^{-5}$ mole per mole of silver halide to the large size emulsion B and $1.0\times10^{-5}$ mole per mole of silver halide to the small size emulsion B).

Red-sensitive emulsion layer
Sensitizing dye E

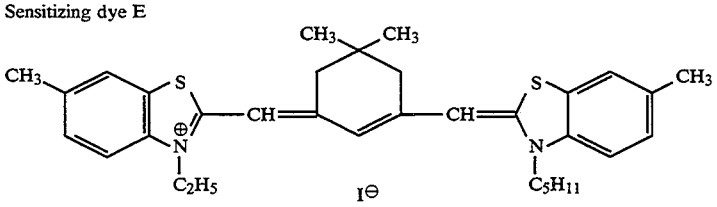

Compound F

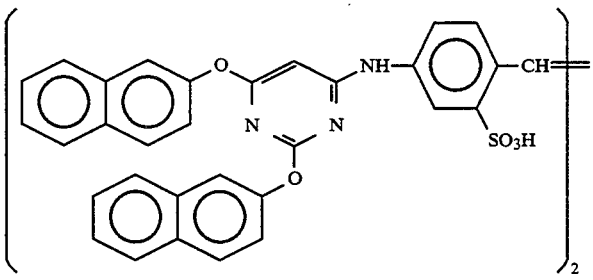

Further, 1-(5-methylureidophenyl)-5-mercaptotetrazole was added to the blue-sensitive layer, green-sensitive layer and red-sensitive layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive layer and green-sensitive layer in the amounts of $1\times10^{-4}$ mole and $2\times10^{-4}$ mole per mole of silver halide, respectively.

The following dyes (the number in the parenthesis represents a coated amount) was added to the following emulsion layers for preventing irradiation:

First layer (blue-sensitive emulsion layer)

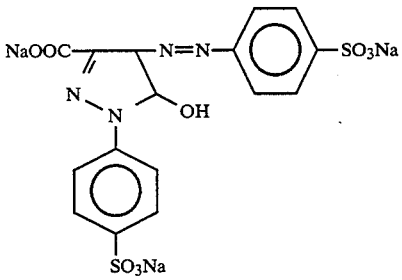

(10 mg/m$^2$)

Third layer (green-sensitive emulsion layer)

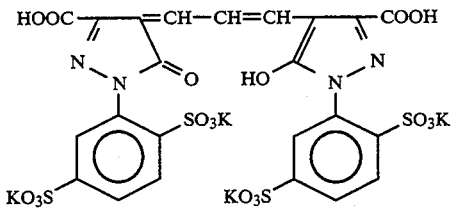

(10 mg/M$^2$)

Fifth layer (red-sensitive emulsion layer)

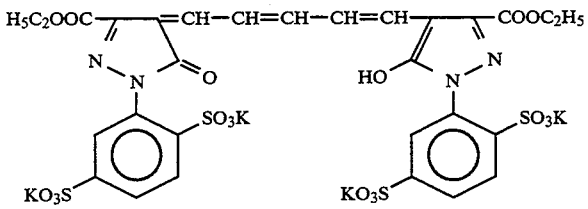

(40 mg/m$^2$)

and

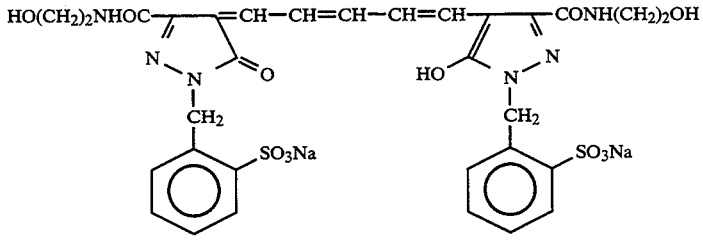

(20 mg/m$^2$)

Layer constitution

The compositions of the respective layers are shown below. The numbers represent the coated amounts (g/m$^2$). The coated amounts of the silver halide emulsions are expressed in terms of the amounts converted to silver.

Support:

Polyethylene laminated paper (polyethylene coated on the 1st layer side contains a white pigment/$TiO_2$ and a blue dye/ultramarine).

| First layer: a blue-sensitive emulsion layer: | |
|---|---|
| Above silver bromochloride emulsion A | 0.27 |
| Gelatin | 1.36 |

-continued

| | |
|---|---|
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer: an anti-color mixing layer: | |
| Gelatin | 1.00 |
| Anti-color mixing agent (Cpd-4) | 0.06 |
| Solvent (Solv-7) | 0.03 |
| Solvent (Solv-2) | 0.25 |
| Solvent (Solv-3) | 0.25 |
| Third layer: a green-sensitive emulsion layer: | |
| Silver bromochloride emulsion B (cube; 1:3 mixture (Ag mole ratio) of a large size emulsion B having an average grain size of 0.55 μm and a small size emulsion B having an average grain size of 0.39 μm, wherein the variation coefficients in the grain size distributions were 0.10 and 0.08, respectively, and both size emulsions contained grains in which AgBr 0.8 mol % was localized on a part of the surface thereof) | 0.27 |
| Gelatin | 1.40 |
| Magenta coupler (ExM) | 0.36 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.55 |
| Solvent (Solv-4) | 0.17 |
| Solvent (Solv-5) | 0.17 |
| Fourth layer: an anti-color mixing layer: | |
| Gelatin | 0.70 |
| Anti-color mixing agent (Cpd-4) | 0.07 |
| Solvent (Solv-7) | 0.03 |
| Solvent (Solv-2) | 0.20 |
| Solvent (Solv-3) | 0.20 |
| Fifth layer: a red-sensitive emulsion layer: | |
| Above silver bromochloride emulsion C | 0.20 |
| Gelatin | 1.30 |
| Cyan coupler (ExC) | 0.34 |
| UV absorber (UV-2) | 0.18 |
| Dye image stabilizer (Cpd-1) | 0.30 |
| Dye image stabilizer (Cpd-6) | 0.01 |
| Dye image stabilizer (Cpd-8) | 0.01 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-1) | 0.02 |
| Solvent (Solv-6) | 0.68 |
| Sixth layer: a UV absorbing layer: | |
| Gelatin | 0.55 |
| UV absorber (UV-1) | 0.38 |
| Dye image stabilizer (Cpd-12) | 0.15 |
| Dye image stabilizer (Cpd-5) | 0.03 |
| Seventh layer: a protective layer | |
| Seventh layer: a protective layer: | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-13) | 0.01 |

Yellow coupler (ExY)
1:1 mixture (mole ratio) of

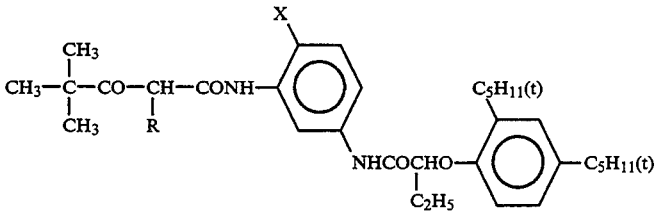

-continued
R = 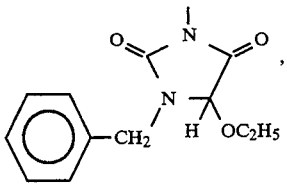 , X = Cl and R = 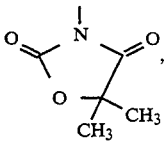 , X = $OCH_3$
Magenta coupler (ExM)
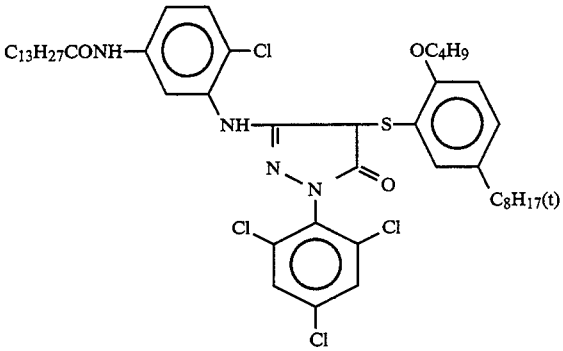
Cyan coupler (ExC)
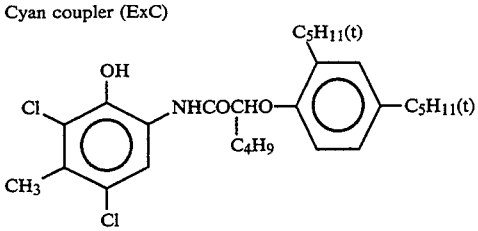
Dye image stabilizer (Cpd-1)
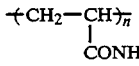
(Average molecular weight 60,000)
Dye image stabilizer (Cpd-2)
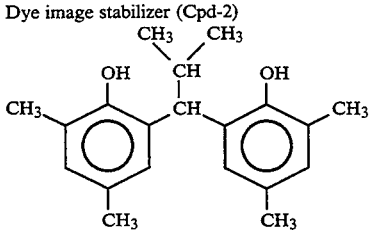
Dye image stabilizer (Cpd-3)
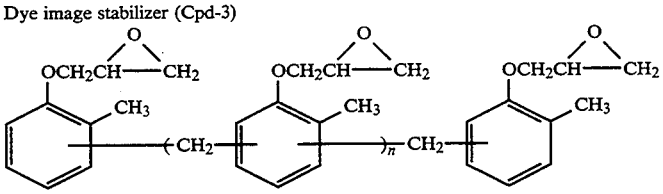
n = 7 to 8 (average value)
Anti-color mixing agent (Cpd-4)
1:1 mixture (mole ratio) of
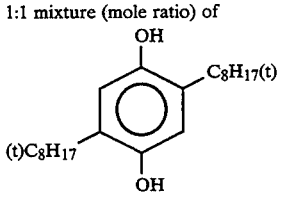
and
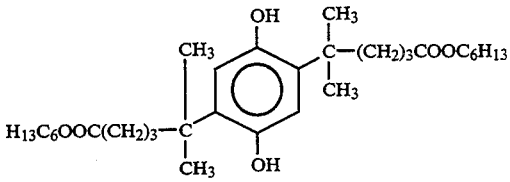
Dye image stabilizer (Cpd-5)

-continued
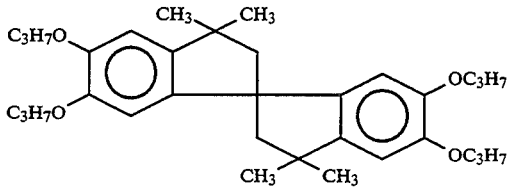
(Cpd-6)
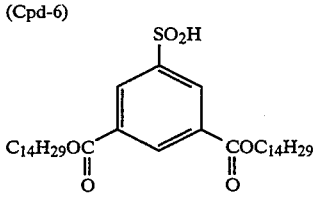
(Cpd-7)
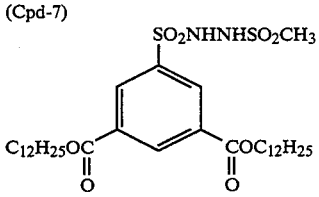
Dye image stabilizer (Cpd-8)
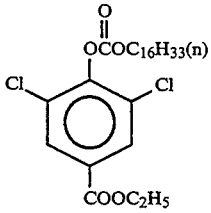
Dye image stabilizer (Cpd-9)
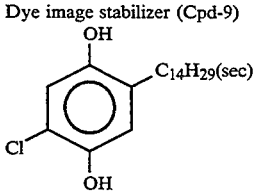
Dye image stabilizer (Cpd-10)
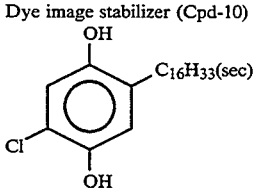
(Cpd-11)
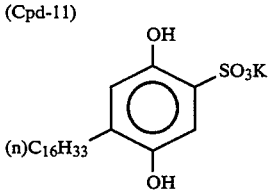
(Cpd-12)
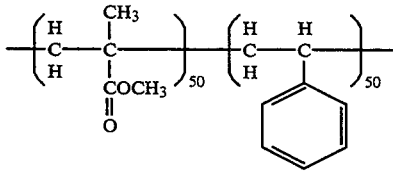
Average molecular weight: 60,000

-continued
(Cpd-13)
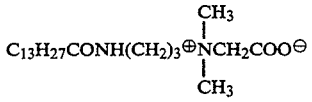
Preservative (Cpd-14)
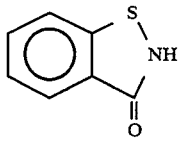
Preservative (Cpd-15)
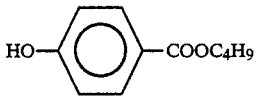
UV absorber (UV-1)
10:5:1:5 mixture (weight ratio) of
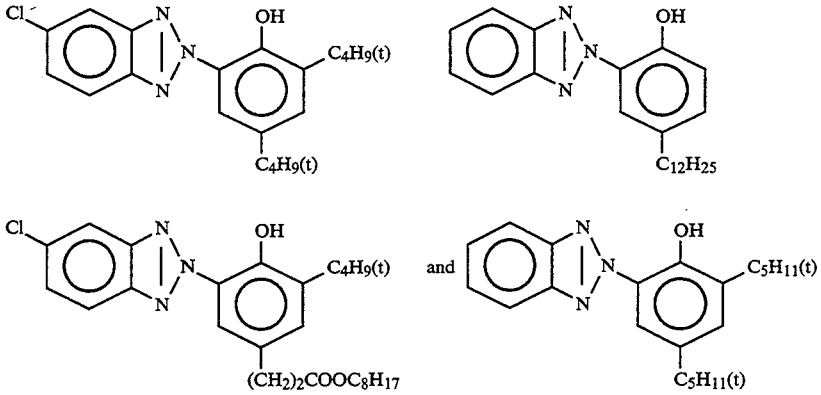
UV absorber (UV-2)
1:2:2 mixture (weight ratio) of
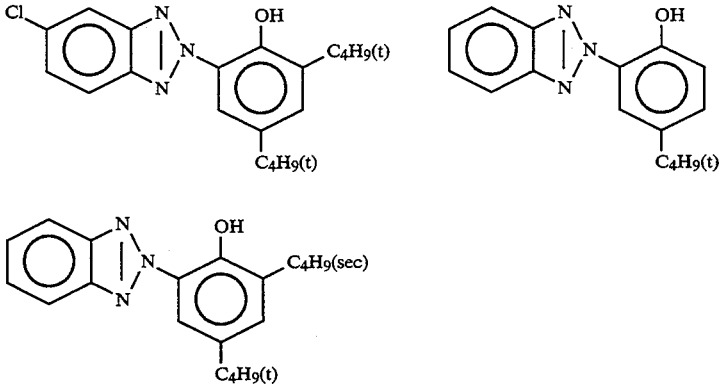
Solvent (Solv-1)
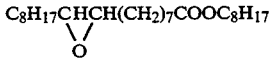
Solvent (Solv-2)
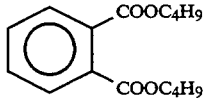
Solvent (Solv-3)

-continued

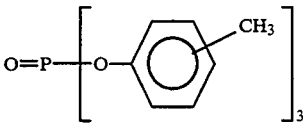

Solvent (Solv-4)

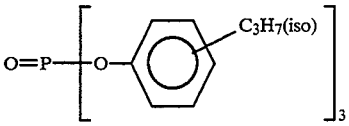

Solvent (Solv-5)

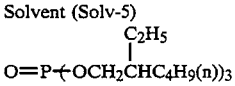

Solvent (Solv-6)

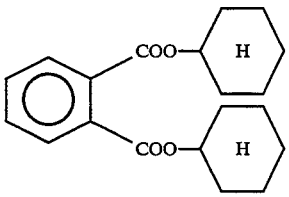

Solvent (Solv-7)

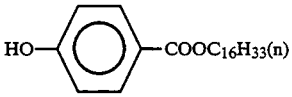

The sample thus prepared is designated as Sample 101.

Next, Sample 102 was prepared in the same manner as Sample 101, except that the cyan coupler ExC used for the fifth layer (a red-sensitive emulsion layer) of Sample 101 was replaced with an equimolar amount of the pyrrolotriazole type coupler (1) of the present invention represented by the above Formula (I-a).

Subsequently, Samples 103 to 114 were prepared in the same manner as Sample 101 except that the cyan coupler ExC used for the fifth layer of Sample 101 was replaced with equimolar amounts of the cyan couplers shown in Table 1 below and that the magenta coupler ExM used for the third layer (a green-sensitive layer) was replaced with equimolar amounts of the magenta couplers of the present invention represented by the above Formulas (M-II) and (M-III), provided that the coated amount of the silver bromochloride emulsion used for the third layer was reduced to a half, 0.135 g/m$^2$ as converted to a silver amount. The chemical structures of the comparative couplers identified in Table 1 are shown as follows:

Comparative coupler (a)
Exemplified Coupler (2) described in European Patent Publication 342,637

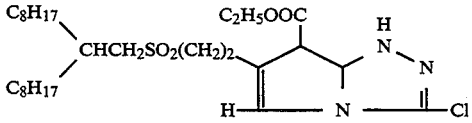

Comparative coupler (b)
Exemplified Coupler (5) described in JP-A-63-264753

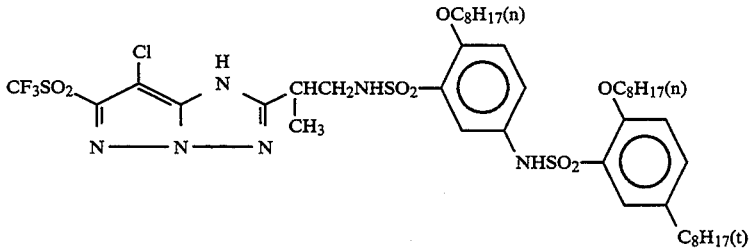

-continued

Comparative coupler (c)
Exemplified Coupler [II]-3-5 described in U.S. Pat. No. 4,873,183

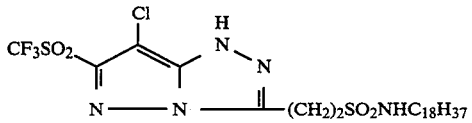

Samples 101 to 114 thus prepared were cut, and the respective samples were subjected to a gradation exposure via a three colors separation filter for a sensitometry with a sensitometer (an FWH type, manufactured by Fuji Photo Film Co., Ltd., a color temperature of a light source: 3200° K.), wherein the exposure was carried out so that the exposure became 250 CMS at an exposing time of 0.1 second.

The samples thus exposed were subjected to continuous processing (a running test) by the following steps in the following processing solutions with a paper processing machine until the replenishing solution became three times as much as the tank capacity of a color developing solution. Then, the samples were processed for evaluating the following performances.

| Processing step | Temperature | Time | Replenishing solution* | Tank capacity |
|---|---|---|---|---|
| Color developing | 38.5° C. | 45 seconds | 73 ml | 10 l |
| Bleach/fixing | 35° C. | 45 seconds | 60 ml** | 10 l |
| Rinsing (1) | 35° C. | 30 seconds | — | 5 l |
| Rinsing (2) | 35° C. | 30 seconds | — | 5 l |
| Rinsing (3) | 35° C. | 30 seconds | 360 ml | 5 l |
| Drying | 80° C. | 60 seconds | | |

*Replenishing amount is per $m^2$ of the light-sensitive material.
**In addition to the above 60 ml of replenishing solution, 120 ml per $m^2$ of the light-sensitive material were flowed in from Rinsing (1).

The rinsing step employed a 3-tank counter-current system from Rinsing (3) to (1).

The compositions of the respective processing solutions were as follows:

| | Tank Solution | Replenishing solution |
|---|---|---|
| Color developing solution | | |
| Water | 800 ml | 800 ml |
| Ethylenediaminetetracetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent, (Whitex 4 manufactured by Sumitomo Chem., Ind.) | 1.0 g | 3.0 g |
| Sodium sulfite | 0.1 g | 0.1 g |
| Disodium N,N-bis(sulfonateethyl)hydroxylamine | 5.0 g | 10.0 g |
| Sodium triisopropylnaphthalene (8) sulfonate | 0.1 g | 0.1 g |
| N-ethyl-N-(β-methanesulfonamideethyl)-3-methyl-4-aminoaniline 3/2 sulfate monohydrate | 5.0 g | 11.5 g |
| Water was added to | 1000 ml | 1000 ml |
| pH (adjusted with potassium hydroxide and sulfuric acid at 25° C.) | 10.00 | 10.00 |

-continued

| | Tank Solution | Replenishing solution |
|---|---|---|
| Bleach/fixing solution | | |
| Water | 600 ml | 150 ml |
| Ammonium thiosulfate (700 g/liter) | 100 ml | 250 ml |
| Ammonium sulfite | 40 g | 100 g |
| Iron (III) ammonium ethylenediaminetetracetate | 55 g | 135 g |
| Ethylenediaminetetracetic acid | 5 g | 12.5 g |
| Ammonium bromide | 40 g | 75 g |
| Nitric acid (67%) | 30 g | 65 g |
| Water was added to | 1000 ml | 1000 ml |
| pH (adjusted with acetic acid and aqueous ammonia at 25° C.) | 5.8 | 5.6 |
| Rinsing solution (the tank solution and replenishing solution were the same) | | |
| Chlorinated sodium isocyanurate | 0.02 g | |
| Deionized water (dielectric constant: 5 μs/cm or less) | 1000 ml | |
| pH | 6.5 | |

The samples thus processed were subjected to measurement of reflection density to obtain the characteristic curves. The following performances were evaluated.

(1) Color developability:

The logarithm of the exposure which give the minimum density (Dmin)+0.5 was obtained from each of the characteristic curves, and this was designated as a sensitivity point (S) for each sample, and was used to calculate the difference (ΔS) from the (S) value of Sample 101 which was set up as the reference.

Further, the density was obtained of a point at which the exposure corresponding to the sensitivity point (S) plus log=0.3 in a high exposure side is achieved, and there was calculated the density ratio (D %) of the above obtained density value for each sample to that of Sample 101 which was similarly set up as the reference.

The results are shown for a cyano dye image (R) and a magenta dye image (G) in Table 1. A higher positive value of (ΔS) shows that a higher sensitivity is achieved, and a (D %) having a value larger than 100 shows that a higher color density was obtained.

(2) Dye image fastness:

For evaluating moisture/heat fastness, a dye image was stored at the condition of 80° C. and 70% relative humidity (RH) for 10 days. For evaluating heat fastness, the dye image was stored at the condition of 100° C. for 5 days. For evaluating light fastness, the dye image was exposed with a xenon fading tester (illuminance: 80,000 lux) for 10 days. After finishing the test, these samples were subjected once again to the density measurement, and the density of the portion giving the density of 1.0 before the exposure test was measured after the test to calculate a dye image residual rate (%). The results of a cyan dye image and a magenta dye image are shown as well in Table 1. A value closer to 100 shows that the dye image fastness is excellent.

(3) Color reproducibility:

The color density of the respective cyan dye images and magenta dye images was measured by respective blue (B) densities and the blue (B) densities of these images corresponding to a density of 1.0 for the cyan and magenta dye images were determined. The differences (ΔD) of the blue (B) densities of the respective samples from that of Sample 101 which was similarly set up as the reference were obtained. A larger negative value shows that an undesired absorption was less in a blue light region and that an excellent color reproduction was obtained. The results are shown in Table 1.

image fastnesses of the cyan and magenta dye images as compared to comparison Samples 101 to 106. The fastnesses of the yellow dye image to moisture/heat, heat and light of Samples 107 to 114 were 94, 97 and 95, respectively. When these results are taken into consideration together it can be seen that with Samples 107 to 114 three colors of the cyan, magenta and yellow dye images are fast, these three colors are balanced and have an excellent dye image fastness showing no change in color tone.

EXAMPLE 2

Samples 201 to 221 were prepared in the same manner as Sample 107, except that the cyan coupler (1) of

TABLE 1

| | Coupler | | Color developability | | | | Dye image fastness | | | | | | Color reproducibility | |
|---|---|---|---|---|---|---|---|---|---|---|---|---|---|---|
| | | | Cyan | | Magenta | | Cyan | | | Magenta | | | | |
| Sample No. | 5th*1 layer | 3rd*2 layer | ΔS | D (%) | ΔS | D (%) | H/H*3 | Heat | Light | H/H*3 | Heat | Light | Cyan | Magenta |
| 101 (Comp.) | ExC | ExM | 0.00 (Ref) | 100 (Ref) | 0.00 (Ref) | 100 (Ref) | 80 | 70 | 93 | 93 | 96 | 82 | 0.00 (Ref) | 0.00 (Ref) |
| 102 (Comp.) | (1) | ExM | +0.02 | 107 | 0.00 | 100 | 96 | 97 | 94 | 93 | 96 | 82 | −0.05 | 0.00 |
| 103 (Comp.) | ExC | M-10 | 0.00 | 100 | +0.03 | 105 | 80 | 70 | 93 | 97 | 98 | 96 | 0.00 | −0.11 |
| 104 (Comp.) | (a)*4 | M-10 | −0.28 | 31 | +0.03 | 105 | 92 | 93 | 90 | 97 | 98 | 96 | −0.02 | −0.11 |
| 105 (Comp.) | (b)*4 | M-10 | −0.19 | 48 | +0.03 | 105 | 94 | 94 | 91 | 97 | 98 | 96 | 0.00 | −0.11 |
| 106 (Comp.) | (c)*4 | M-10 | −0.22 | 43 | +0.03 | 105 | 93 | 93 | 90 | 97 | 98 | 96 | 0.00 | −0.11 |
| 107 (Inv.) | (1) | M-10 | +0.06 | 115 | +0.03 | 108 | 98 | 99 | 96 | 99 | 99 | 98 | −0.07 | −0.12 |
| 108 (Inv.) | (39) | M-10 | +0.06 | 114 | +0.05 | 108 | 97 | 98 | 96 | 99 | 99 | 98 | −0.07 | −0.12 |
| 109 (Inv.) | (27) | M-10 | +0.04 | 112 | +0.05 | 108 | 96 | 96 | 95 | 99 | 99 | 98 | −0.06 | −0.12 |
| 110 (Inv.) | (49) | M-10 | +0.03 | 110 | +0.05 | 108 | 96 | 96 | 95 | 99 | 99 | 98 | −0.06 | −0.12 |
| 111 (Inv.) | (1) | m-2 | +0.05 | 113 | +0.04 | 106 | 98 | 99 | 96 | 97 | 98 | 96 | −0.07 | −0.11 |
| 112 (Inv.) | (39) | m-2 | +0.05 | 113 | +0.04 | 106 | 97 | 98 | 96 | 97 | 98 | 96 | −0.07 | −0.11 |
| 113 (Inv.) | (21) | m-2 | +0.03 | 111 | +0.03 | 106 | 96 | 96 | 95 | 97 | 97 | 96 | −0.06 | −0.11 |
| 114 (Inv.) | (49) | m-2 | +0.02 | 109 | +0.03 | 106 | 96 | 96 | 95 | 97 | 97 | 96 | −0.06 | −0.11 |

*1: a red-sensitive emulsion layer.
*2: a green-sensitive emulsion layer.
*3: Humidity/heat.
*4: a comparative coupler.

It can be found from the results summarized in the above Table 1 that Samples 107 to 114 in which the pyrrolotriazole type cyan couplers of the present invention represented by the above Formula (I) or (II) and the pyrazlotriazole type magenta couplers of the present invention represented by the above Formula (M-II) or (M-III) are used in combination have excellent color developability, dye image fastness and color reproducibility in both the cyan dye image and magenta dye image, as compared with Samples 101 to 106 which are the comparative samples.

It also can be found that Samples 104 to 106 in which comparative cyan couplers used, have low sensitivity and low density of the developed color in a color developability of a cyan dye image, while having an improved in dye image fastness of the cyan dye image and also that it is difficult to use them in terms of photographic performances.

Also, it can be found from a comparison of Samples 107 and 108 with Samples 109 and 110 or Samples 111 and 112 with Samples 113 and 114 that the pyrrolotriazole type couplers of the present invention represented by Formula (I) or (II), to be more specific, the couplers represented by Formula (I-a) or (I-b) are more preferred than the couplers represented by Formula (III-a) or (II-b) in terms of color developability and a dye image fastness.

Further, it is apparent that Samples 107 to 114 containing both the pyrrolotriazole type cyan couplers of the present invention represented by the above Formula (I) or (II) and the pyrazlotriazole type magenta couplers of the present invention represented by the above Formula (M-II) or (M-III) are clearly improved in dye the present invention contained in the fifth layer (a red-sensitive layer) and the magenta coupler M-10 of the present invention contained in the third layer (a green-sensitive layer) were replaced with the same moles of the couplers, respectively, as shown in Tables 2 and 3.

These samples thus prepared were exposed and then processed with a paper processing machine by the following processing steps in the processing solutions of the following compositions by carrying out a continuous (running) test.

| Processing step | Temperature | Time | Replenishing solution* | Tank capacity |
|---|---|---|---|---|
| Color developing | 35° C. | 45 seconds | 161 ml | 10 l |
| Bleach/fixing | 35° C. | 45 seconds | 215 ml | 10 l |
| Rinsing (1) | 35° C. | 20 seconds | — | 5 l |
| Rinsing (2) | 35° C. | 20 seconds | — | 5 l |
| Rinsing (3) | 35° C. | 20 seconds | — | 5 l |
| Rinsing (4) | 35° C. | 20 seconds | 248 ml | 5 l |
| Drying | 80° C. | 60 seconds | | |

*Replenishing amount is per $m^2$ of the light-sensitive material.

The rinsing step employed a 4-tank counter-current system from Rinsing (4) to (1).

The compositions of the respective processing solutions were as follows:

| Color developing solution | Tank Solution | Replenishing solution |
|---|---|---|

-continued

| | | |
|---|---|---|
| Water | 800 ml | 800 ml |
| 1-Hydroxyethylidene-1,1-diphosphonic acid (60%) | 0.8 ml | 0.8 ml |
| Lithium sulfate (anhydrous) | 2.7 g | 2.7 g |
| Triethanolamine | 8.0 g | 8.0 g |
| Sodium chloride | 1.4 g | — |
| Potassium bromide | 0.03 g | 0.025 g |
| Diethylhydroxylamine | 4.6 g | 7.2 g |
| Potassium carbonate | 27 g | 27 g |
| Sodium sulfite | 0.1 g | 0.2 g |
| N-ethyl-N-(β-methanesulfonamidoethyl)-3-methyl-4-aminoaniline 3/2 sulfate monohydrate | 4.5 g | 7.3 g |
| Fluorescent whitening agent (4,4'-diaminostilbene type) | 2.0 g | 3.0 g |
| Water was added to | 1000 ml | 1000 ml |
| pH (adjusted with potassium hydroxide) | 10.25 | 10.80 |

Bleach/fixing solution (the tank solution and replenishing solution were the same)

| | |
|---|---|
| Water | 400 ml |
| Ammonium thiosulfate (700 g/liter) | 100 ml |
| Sodium sulfite | 17 g |
| Iron (III) ammonium ethylenediaminetetracetate | 55 g |
| Disodium ethylenediaminetetracetate | 5 g |
| Glacial acetic acid | 9 g |
| Water was added to | 1000 ml |
| pH (25° C.) | 5.40 |

Rinsing solution (the tank solution and replenishing solution were the same)

| | |
|---|---|
| Benzoisothiazoline-3-one | 0.02 g |
| Polyvinylpyrrolidone | 0.05 g |
| Water was added to | 1000 ml |
| pH | 7.0 |

The samples thus processed were subjected to performance evaluation in the same manner as Example 1, wherein Sample 101 of Example 1 was set up as the reference in the evaluation of color developability and color reproducibility. The results are shown in Tables 2 and 3.

TABLE 2

| | Coupler | | Color developability | | | | Dye image fastness | | | | | | Color reproducibility | |
|---|---|---|---|---|---|---|---|---|---|---|---|---|---|---|
| | 5th*1 | 3rd*2 | Cyan | | Magenta | | Cyan | | | Magenta | | | | |
| Sample No. | layer | layer | ΔS | D (%) | ΔS | D (%) | H/H*3 | Heat | Light | H/H*3 | Heat | Light | Cyan | Magenta |
| 201 (Inv.) | (2) | M-1 | +0.06 | 115 | +0.05 | 107 | 98 | 98 | 96 | 99 | 99 | 98 | −0.07 | −0.12 |
| 202 (Inv.) | (1) | M-4 | +0.06 | 115 | +0.05 | 107 | 98 | 99 | 96 | 98 | 98 | 97 | −0.07 | −0.12 |
| 203 (Inv.) | (19) | M-7 | +0.06 | 115 | +0.05 | 107 | 98 | 99 | 96 | 99 | 99 | 98 | −0.07 | −0.12 |
| 204 (Inv.) | (20) | M-12 | +0.06 | 115 | +0.06 | 108 | 98 | 99 | 96 | 99 | 99 | 98 | −0.07 | −0.12 |
| 205 (Inv.) | (15) | m-1 | +0.06 | 113 | +0.04 | 106 | 97 | 98 | 96 | 97 | 98 | 96 | −0.07 | −0.11 |
| 206 (Inv.) | (41) | m-5 | +0.06 | 115 | +0.04 | 106 | 98 | 99 | 96 | 97 | 98 | 96 | −0.07 | −0.11 |
| 207 (Inv.) | (9) | m-11 | +0.06 | 115 | +0.04 | 106 | 98 | 99 | 95 | 96 | 97 | 95 | −0.07 | −0.11 |
| 208 (Inv.) | (30) | M-2 | +0.06 | 114 | +0.05 | 107 | 97 | 98 | 96 | 98 | 98 | 97 | −0.07 | −0.12 |
| 209 (Inv.) | (33) | M-3 | +0.06 | 113 | +0.05 | 107 | 97 | 98 | 95 | 99 | 99 | 98 | −0.07 | −0.12 |
| 210 (Inv.) | (36) | M-33 | +0.06 | 113 | +0.07 | 108 | 96 | 97 | 95 | 97 | 97 | 96 | −0.07 | −0.12 |
| 211 (Inv.) | (34) | m-4 | +0.06 | 112 | +0.05 | 106 | 97 | 98 | 96 | 97 | 97 | 96 | −0.07 | −0.11 |
| 212 (Inv.) | (39) | m-22 | +0.06 | 112 | +0.04 | 106 | 97 | 98 | 96 | 97 | 97 | 97 | −0.07 | −0.11 |

*1: a red-sensitive emulsion layer.
*2: a green-sensitive emulsion layer.
*3: Humidity/heat.

TABLE 3

| | Coupler | | Color developability | | | | Dye image fastness | | | | | | Color reproducibility | |
|---|---|---|---|---|---|---|---|---|---|---|---|---|---|---|
| | 5th*1 | 3rd*2 | Cyan | | Magenta | | Cyan | | | Magenta | | | | |
| Sample No. | layer | layer | ΔS | D (%) | ΔS | D (%) | H/H*3 | Heat | Light | H/H*3 | Heat | Light | Cyan | Magenta |
| 213 (Inv.) | (23) | M-8 | +0.04 | 111 | +0.05 | 108 | 96 | 96 | 95 | 99 | 99 | 98 | −0.06 | −0.12 |
| 214 (Inv.) | (24) | M-28 | +0.04 | 110 | +0.05 | 108 | 95 | 95 | 94 | 98 | 99 | 97 | −0.06 | −0.12 |
| 215 (Inv.) | (25) | m-7 | +0.04 | 111 | +0.04 | 106 | 95 | 95 | 94 | 97 | 98 | 96 | −0.06 | −0.11 |
| 216 (Inv.) | (27) | m-14 | +0.04 | 112 | +0.05 | 107 | 96 | 96 | 95 | 95 | 96 | 94 | −0.06 | −0.11 |
| 217 (Inv.) | (28) | m-19 | +0.04 | 111 | +0.04 | 106 | 96 | 96 | 95 | 95 | 96 | 94 | −0.06 | −0.11 |
| 218 (Inv.) | (42) | M-5 | +0.04 | 110 | +0.04 | 107 | 95 | 95 | 94 | 98 | 99 | 97 | −0.06 | −0.12 |
| 219 (Inv.) | (44) | M-19 | +0.04 | 110 | +0.06 | 108 | 95 | 95 | 94 | 97 | 98 | 96 | −0.06 | −0.12 |
| 220 (Inv.) | (4g) | m-3 | +0.03 | 109 | +0.03 | 106 | 95 | 95 | 94 | 97 | 98 | 96 | −0.06 | −0.11 |
| 221 (Inv.) | (46) | m-10 | +0.04 | 110 | +0.04 | 106 | 95 | 95 | 94 | 96 | 97 | 95 | −0.06 | −0.11 |

*1: a red-sensitive emulsion layer.
*2: a green-sensitive emulsion layer.
*3: Humidity/heat.

It could be confirmed from the results summarized in Tables 2 and 3 that the combined use of the pyrrolotriazole type cyan couplers of the present invention represented by the above Formula (I) or (II) and the pyrazolotriazole type magenta couplers of the present invention represented by the above Formula (M-II) or (M-III) provided excellent color developability, dye image fastness and color reproducibility in both the cyan dye image and magenta dye image.

When the fastness of the yellow dye image shown in Example 1 (94 to moisture/heat, 97 to heat and 95 to light) is taken together into consideration for evaluation, it also is apparent that the balance of the fastness of the cyan, magenta and yellow dye images is improved.

Further, it also can be found from a comparison of Samples 201 to 212 with Samples 213 to 221 that in the pyrrolotriazole type cyan couplers of the present invention represented by Formula (I) or (II), the couplers represented by the more specific Formula (I-a) or (I-b) provide more excellent characteristics shown above in comparison with the couplers represented by Formula (II-a) or (II-b).

EXAMPLE 3

Sample 301 was prepared in the same manner as Sample 201 in Example 2 of JP-A-2-854, except that the addition amounts of the coupler solvents (*8 and *9) contained in the third layer and fourth layer were changed to 0.20 g/m2 and 0.30 g/m$^2$, respectively. Further, Samples 302 to 306 were prepared in the same manner as Sample 301, except that the cyan couplers (*3) and (*4) contained in the third layer and fourth layer were replaced, respectively, with the same moles of the couplers as shown in Table 4 below.

TABLE 4

| Sample No. | Coupler: Third layer | Coupler: Fourth layer |
|---|---|---|
| 301 (Comp.) | Coupler (*3)/Coupler (*4) = 2/1 (weight ratio) | Coupler (*3)/Coupler (*4) = 2/1 (weight ratio) |
| 302 (Inv.) | Same as above | (3)/(39) = 1/1 (mole ratio) |
| 303 (Inv.) | (1)/Coupler (*3) = 1/1 (mole ratio) | (1)/Coupler (*3) = 1/1 (mole ratio) |
| 304 (Inv.) | (1)/Coupler (*4) = 1/1 (mole ratio) | (1)/Coupler (*4) = 1/1 (mole ratio) |
| 305 (Inv.) | (3)/(39) = 1/1 (mole ratio) | (3)/(39) = 1/1 (mole ratio) |
| 306 (Inv.) | (33)/(34) = 1/1 (mole ratio) | (18)/(19) = 1/1 (mole ratio) |

Coupler (*3): 2-[α-(2,4-di-t-amylphenoxy) hexanamide]-4,6-dichloro-5-ethylphenol.
Coupler (*4): 2-(2-chlorobenzoylamide)-4-chloro-5-[α-(2-chloro-4-t-amylphenoxy)octanamide]-phenol.

The silver halide color photographic light-sensitive materials thus prepared were exposed and then processed with an automatic developing machine by the method described in Example 2 of JP-A-2-854.

It could be confirmed from the characteristic curves of the samples thus processed and obtained that Samples 305 and 306 in which the pyrrolotriazole type cyan couplers of the present invention represented by Formula (I) or (II) were used had more excellent color developability and color reproducibility than those of comparison Sample 301. Further, it could also be confirmed that in Samples 302 to 304 in which the pyrrolotriazole couplers of the present invention were used to replace in part the comparison couplers (*3) and (*4), the color develpability and color reproducibility were improved more than comparison Sample 301, but were a little inferior to Samples 305 and 306 in which the pyrrolotriazole couplers of the present invention totally replaced the comparison couplers.

Further, a color image was printed on Samples 301 to 306, which were subjected to the above processing, and the samples thus processed were compared. It was found that Samples 302 to 306 which met the constitutional conditions of the present invention showed more vivid colors than that of the comparative sample, and that when the samples which were subjected to the dye image fastness test in the test conditions shown in Example 1 were compared, the fade balance of cyan, magenta and yellow colors were found to be improved and Samples 302 to 306 showed further excellent dye image, which dye images after the fastness test were as if no dye images fastness test were carried out. Particularly in Samples 305 and 306, the effect provided by the balanced dye image fastness of the three colors due to the improvement in the above cyan dye image fastness was notable.

EXAMPLE 4

Sample 401 was prepared in the same manner as Sample 101 prepared in Example 1 of JP-A-2-854, except that the coated amounts of the high boiling solvent (0–2) used for the third layer (the first red-sensitive layer), fourth layer (the second red-sensitive layer) and the fifth layer (the third red-sensitive layer) were changed to 0.16 ml/m$^2$, 0.45 ml/m$^2$ and 0.55 ml/m$^2$, respectively, and that the magenta coupler C-3 used for the seventh layer (the first green-sensitive layer) and eighth layer (the second green-sensitive layer) was replaced with the same mole amount of the following magenta coupler.

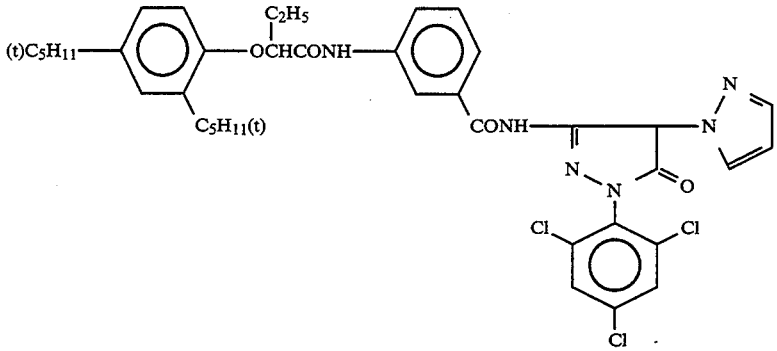

Next, Sample 402 was prepared in the same manner as Sample 401, except that the cyan couplers C-1 and C-2 used for the third and fourth layers were replaced with the same moles of the pyrrolotriazole type cyan couplers (2) and (34) of the present invention represented by Formula (I) or (II), respectively, and the cyan couplers C-6 and C-8 used for the fifth layer were replaced with the same moles of pyrrolotriazole type cyan couplers (20) and (32) of the present invention represented by Formula (I) or(II), respectively, and that the magenta coupler C-3 used for the seventh coupler was replaced with the same mole of a 1:1 mixture (molar ratio) of the pyrazolotriazole type magenta coupler M-7 of the present invention represented by Formula (M-II) and m-5 of the present invention represented by Formula (M-III) and further the magenta coupler C-4 used for the ninth layer was replaced with the same moles (the constitutional unit of C-4 was converted to moles) of the coupler M-30 of the present invention as well.

These Samples 401 and 402 thus prepared were subjected to a gradational exposure via a three colors separation filter and then to a processing by the processing steps and in the processing solutions each described in Example 1 of JP-A-2-854.

The samples thus processed were subjected to a density measurement to obtain the characteristic curves.

It could be confirmed from these characteristic curves that Sample 402 which met the constitutional conditions of the present invention provided a good color developability (sensitivity and developed density) as compared with that of Sample 401.

Further, the dye image fastness of these samples was checked under the same conditions as Example 1 of the present specification and it to confirmed that the fastnesses to high temperature, a high temperature-humidity and light of Sample 402 which met the constitutional conditions of the present invention were excellent as compared with those of Sample 401, and that the dye image fastness showed a well balanced performance in which the fading levels of the three colors of cyan, magenta and yellow were well arranged.

Further, the samples thus prepared were cut and subjected to photographing of various images with a camera for comparing them by projection, and it was confirmed that Sample 402 of the present invention had a brilliant color and an excellent color reproducibility as compared with those of Sample 401.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and provided thereon a silver halide light-sensitive layer containing a cyan coupler, a silver halide light-sensitive layer containing a magenta coupler, and a silver halide light-sensitive layer containing a yellow coupler, wherein the silver halide light-sensitive layer containing the cyan coupler contains at least one pyrrolotriazole cyan coupler represented by the following Formula (I-b) or (II-b) as a cyan coupler and the silver halide light-sensitive layer containing the magenta coupler contains a pyrazoloazole magenta coupler represented by the following Formula (M) as a magenta coupler:

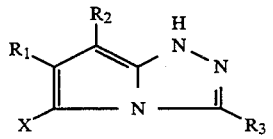
(I-b)

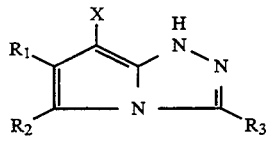
(II-b)

wherein $R_1$ and $R_2$ each represents an electron attractive group having a Hammett's substituent constant $\sigma_p$ of 0.2 or more and the sum of the $\sigma_p$ values of $R_1$ and $R_2$ is 0.65 or more; $R_3$ represents an alkyl group, an aryl group, a cyano group, a nitro group, a carboxy group, a sulfo group, an acylamino group, an anilino group, a ureido group, a carbamoyl group, a sulfamoyl group, a sulfonyl group, alkoxycarbonyl group, a silyloxy group, an aryloxycarbonylamino group, a sulfinyl group, a phosphonyl group, an aryloxycarbonyl group, or an acyl group; X represents a hydrogen atom or a group capable of splitting off upon a reaction with an oxidation product of an aromatic primary amine color developing agent; and the group represented by $R_1$, $R_2$, $R_3$ or X may be a divalent group and combine with a polymer which is higher than a dimer and which has a high molecular weight chain to form a homopolymer or a copolymer;

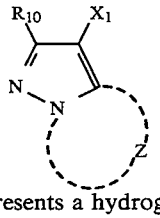
(M)

wherein $R_{10}$ represents a hydrogen atom or a substituent; Z represents a group of non-metallic atoms necessary to form a 5-membered azole ring containing 2 to 3 nitrogen atoms; and $X_1$ represents a hydrogen atom or a group capable of splitting off upon a coupling reaction with an oxidation product of an aromatic primary amine color developing agent.

2. The silver halide color photographic light-sensitive material of claim 1, wherein $R_1$ and $R_2$ each independently represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom an azo group, or a selenocyanate group.

3. The silver halide color photographic light-sensitive material of claim 2, wherein $R_1$ and $R_2$ each represents an alkoxycarbonyl group, a nitro group, a cyano group, an arylsulfonyl group, a carbamoyl group, a halogenated alkyl group, or an aryloxycarbonyl group.

4. The silver halide color photographic light-sensitive material of claim 3, wherein $R_1$ represents a cyano group and $R_2$ represents a branched alkoxycarbonyl group.

5. The silver halide color photographic light-sensitive material of claim 1, wherein X represents a hydrogen atom a halogen atom, an alkoxy group, an aryloxy group, an acyloxy group, an alkyl- or arylsulfonyloxy group, an acylamino group, an alkyl- or arylsulfonamido group, an alkoxycarbonyloxy group, a an aryloxycarbonyloxy group, an alkyl-, aryl- or heterocyclic thio group, a carbamoylamino group, a 5-membered or 6-membered nitrogen-containing heterocyclic group, an imido group, or an arylazo group.

6. The silver halide color photographic light-sensitive material of claim 5, wherein X represents a halogen atom, an alkythio group or an arylthio group.

7. The silver halide color photographic light-sensitive material of claim 1, wherein the silver halide light-sensitive layer containing the cyan coupler is a red-sensitive layer.

8. The silver halide color photographic light-sensitive material of claim 1, wherein the amount of the pyrrolotriazole cyan coupler present in the light-sensitive material is $1\times10^{-3}$ mol to 1 mol per mol of silver halide in said silver halide light-sensitive layer containing the cyan coupler.

9. The silver halide color photographic light-sensitive material of claim 1, wherein the pyrazoloazole magenta coupler is represented by Formula (M-I), (M-II), or (M-III):

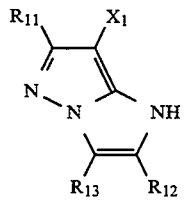

(M-I)

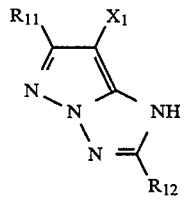

(M-II)

-continued

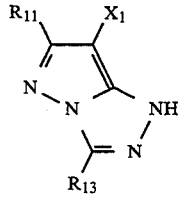

(M-III)

wherein, $R_{11}$, $R_{12}$ and $R_{13}$ have the same meanings respectively as $R_{10}$ in Formula (M) and $X_1$ has the same meaning as in Formula (M).

10. The silver halide color photographic light-sensitive material of claim 9, wherein the pyrazoloazole magenta coupler is represented by Formula (M-II) or (M-III).

11. The silver halide color photographic light-sensitive material of claim 9, wherein $R_{11}$ represents a branched alkyl group having 3 to 8 carbon atoms.

12. The silver halide color photographic light-sensitive material of claim 1, wherein the pyrazoloazole magenta coupler is present in an amount of $1\times10^{-3}$ to 1 mol per mol of silver halide in the silver halide light-sensitive layer containing the magenta coupler.

13. The silver halide color photographic light-sensitive material of claim 1, wherein $R_3$ represents an alkyl group or an aryl group.

* * * * *